US009273260B2

(12) United States Patent
Robinson et al.

(10) Patent No.: US 9,273,260 B2
(45) **Date of Patent: *Mar. 1, 2016**

(54) AGGLOMERATED PARTICULATE LOW-RANK COAL FEEDSTOCK AND USES THEREOF

(71) Applicant: GreatPoint Energy, Inc., Cambridge, MA (US)

(72) Inventors: Earl T. Robinson, Lakeland, FL (US); Kenneth P. Keckler, Naperville, IL (US); Pattabhi K. Raman, Kildeer, IL (US); Avinash Sirdeshpande, Chicago, IL (US)

(73) Assignee: GreatPoint Energy, Inc., Cambridge, MA (US)

( * ) Notice: Subject to any disclaimer, the term of this patent is extended or adjusted under 35 U.S.C. 154(b) by 323 days.

This patent is subject to a terminal disclaimer.

(21) Appl. No.: 14/039,402

(22) Filed: Sep. 27, 2013

(65) Prior Publication Data

US 2014/0094636 A1 Apr. 3, 2014

Related U.S. Application Data

(60) Provisional application No. 61/708,104, filed on Oct. 1, 2012, provisional application No. 61/775,772, filed on Mar. 11, 2013.

(51) Int. Cl.

| | |
|---|---|
| ***C07C 1/00*** | (2006.01) |
| ***C10L 5/04*** | (2006.01) |
| ***C10L 3/08*** | (2006.01) |

(Continued)

(52) U.S. Cl.
CPC ... *C10L 3/08* (2013.01); *C10L 5/10* (2013.01); *C10L 5/363* (2013.01)

(58) Field of Classification Search
CPC ..... C10L 5/04; C07C 1/00
USPC ..... 44/550, 592, 593, 595, 596; 585/733, 585/943
See application file for complete search history.

(56) References Cited

U.S. PATENT DOCUMENTS

| | | | |
|---|---|---|---|
| 2,605,215 | A | 7/1952 | Coghlan |
| 2,694,623 | A | 11/1954 | Welty, Jr. et al. |
| 2,791,549 | A | 5/1957 | Jahnig |

(Continued)

FOREIGN PATENT DOCUMENTS

| | | |
|---|---|---|
| CA | 966660 | 4/1975 |
| CA | 1003217 | 1/1977 |

(Continued)

OTHER PUBLICATIONS

U.S. Appl. No. 12/778,538, filed May 12, 2010, Robinson, et al.

(Continued)

*Primary Examiner* — Thuan D Dang
(74) *Attorney, Agent, or Firm* — McDonnell Boehnen Hulbert & Berghoff LLP

(57) ABSTRACT

The present invention relates generally to processes for preparing agglomerated particulate low-rank coal feedstocks of a particle size suitable for reaction in a fluidized-bed reactor and certain other gasification reactors and, in particular, for coal gasification and combustion applications. The present invention also relates to an integrated coal hydromethanation process including preparing and utilizing such agglomerated particulate low-rank coal feedstocks.

29 Claims, 2 Drawing Sheets

(51) Int. Cl.

| | |
|---|---|
| ***C10L 5/10*** | (2006.01) |
| ***C10L 5/36*** | (2006.01) |

(56) References Cited

U.S. PATENT DOCUMENTS

| | | | |
|---|---|---|---|
| 2,813,126 | A | 11/1957 | Tierney |
| 2,860,959 | A | 11/1958 | Pettyjohn et al. |
| 2,886,405 | A | 5/1959 | Benson et al. |
| 3,034,848 | A | 5/1962 | King |
| 3,114,930 | A | 12/1963 | Oldham et al. |
| 3,150,716 | A | 9/1964 | Strelzoff et al. |
| 3,164,330 | A | 1/1965 | Neidl |
| 3,351,563 | A | 11/1967 | Negra et al. |
| 3,435,590 | A | 4/1969 | Smith |
| 3,531,917 | A | 10/1970 | Grunewald et al. |
| 3,544,291 | A | 12/1970 | Schlinger et al. |
| 3,594,985 | A | 7/1971 | Ameen et al. |
| 3,615,300 | A | 10/1971 | Holm et al. |
| 3,689,240 | A | 9/1972 | Aldridge et al. |
| 3,740,193 | A | 6/1973 | Aldridge et al. |
| 3,746,522 | A | 7/1973 | Donath |
| 3,759,036 | A | 9/1973 | White |
| 3,779,725 | A | 12/1973 | Hegarty et al. |
| 3,814,725 | A | 6/1974 | Zimmerman et al. |
| 3,817,725 | A | 6/1974 | Sieg et al. |
| 3,828,474 | A | 8/1974 | Quartulli |
| 3,833,327 | A | 9/1974 | Pitzer et al. |
| 3,847,567 | A | 11/1974 | Kalina et al. |
| 3,876,393 | A | 4/1975 | Kasai et al. |
| 3,904,386 | A | 9/1975 | Graboski et al. |
| 3,915,670 | A | 10/1975 | Lacey et al. |
| 3,920,229 | A | 11/1975 | Piggott |
| 3,929,431 | A | 12/1975 | Koh et al. |
| 3,958,957 | A | 5/1976 | Koh et al. |
| 3,966,875 | A | 6/1976 | Bratzler et al. |
| 3,969,089 | A | 7/1976 | Moss et al. |
| 3,971,639 | A | 7/1976 | Matthews |
| 3,972,693 | A | 8/1976 | Wiesner et al. |
| 3,975,168 | A | 8/1976 | Gorbaty |
| 3,985,519 | A | 10/1976 | Kalina et al. |
| 3,989,811 | A | 11/1976 | Hill |
| 3,996,014 | A | 12/1976 | Muller et al. |
| 3,998,607 | A | 12/1976 | Wesswlhoft et al. |
| 3,999,607 | A | 12/1976 | Pennington et al. |
| 4,005,996 | A | 2/1977 | Hausberger et al. |
| 4,011,066 | A | 3/1977 | Bratzler et al. |
| 4,017,272 | A | 4/1977 | Anwer et al. |
| 4,021,370 | A | 5/1977 | Harris et al. |
| 4,025,423 | A | 5/1977 | Stonner et al. |
| 4,044,098 | A | 8/1977 | Miller et al. |
| 4,046,523 | A | 9/1977 | Kalina et al. |
| 4,052,176 | A | 10/1977 | Child et al. |
| 4,053,554 | A | 10/1977 | Reed et al. |
| 4,057,512 | A | 11/1977 | Vadovic et al. |
| 4,069,304 | A | 1/1978 | Starkovish et al. |
| 4,077,778 | A | 3/1978 | Nahas et al. |
| 4,091,073 | A | 5/1978 | Winkler |
| 4,092,125 | A | 5/1978 | Stambaugh et al. |
| 4,094,650 | A | 6/1978 | Koh et al. |
| 4,100,256 | A | 7/1978 | Bozzelli et al. |
| 4,101,449 | A | 7/1978 | Noda et al. |
| 4,104,201 | A | 8/1978 | Banks et al. |
| 4,113,615 | A | 9/1978 | Gorbaty |
| 4,116,996 | A | 9/1978 | Huang |
| 4,118,204 | A | 10/1978 | Eakman et al. |
| 4,152,119 | A | 5/1979 | Schulz |
| 4,157,246 | A | 6/1979 | Eakman et al. |
| 4,159,195 | A | 6/1979 | Clavenna |
| 4,162,902 | A | 7/1979 | Wiesner et al. |
| 4,173,465 | A | 11/1979 | Meissner et al. |
| 4,189,307 | A | 2/1980 | Marion |
| 4,192,652 | A | 3/1980 | Smith |
| 4,193,771 | A | 3/1980 | Sharp et al. |
| 4,193,772 | A | 3/1980 | Sharp |
| 4,200,439 | A | 4/1980 | Lang |
| 4,204,843 | A | 5/1980 | Neavel |
| 4,211,538 | A | 7/1980 | Eakman et al. |
| 4,211,669 | A | 7/1980 | Eakman et al. |
| 4,219,338 | A | 8/1980 | Wolfs et al. |
| 4,223,728 | A | 9/1980 | Pegg |
| 4,225,457 | A | 9/1980 | Schulz |
| 4,235,044 | A | 11/1980 | Cheung |
| 4,243,639 | A | 1/1981 | Haas et al. |
| 4,249,471 | A | 2/1981 | Gunnerman |
| 4,252,771 | A | 2/1981 | Lagana et al. |
| 4,260,421 | A | 4/1981 | Brown et al. |
| 4,265,868 | A | 5/1981 | Kamody |
| 4,270,937 | A | 6/1981 | Adler et al. |
| 4,284,416 | A | 8/1981 | Nahas |
| 4,292,048 | A | 9/1981 | Wesselhoft et al. |
| 4,298,584 | A | 11/1981 | Makrides |
| 4,315,753 | A | 2/1982 | Bruckenstein et al. |
| 4,315,758 | A | 2/1982 | Patel et al. |
| 4,318,712 | A | 3/1982 | Lang et al. |
| 4,322,222 | A | 3/1982 | Sass |
| 4,330,305 | A | 5/1982 | Kuessner et al. |
| 4,331,451 | A | 5/1982 | Isogaya et al. |
| 4,334,893 | A | 6/1982 | Lang |
| 4,336,034 | A | 6/1982 | Lang et al. |
| 4,336,233 | A | 6/1982 | Appl et al. |
| 4,341,531 | A | 7/1982 | Duranleau et al. |
| 4,344,486 | A | 8/1982 | Parrish |
| 4,347,063 | A | 8/1982 | Sherwood et al. |
| 4,348,486 | A | 9/1982 | Calvin et al. |
| 4,348,487 | A | 9/1982 | Calvin et al. |
| 4,353,713 | A | 10/1982 | Cheng |
| 4,365,975 | A | 12/1982 | Williams et al. |
| 4,372,755 | A | 2/1983 | Tolman et al. |
| 4,375,362 | A | 3/1983 | Moss |
| 4,385,905 | A | 5/1983 | Tucker |
| 4,397,656 | A | 8/1983 | Ketkar |
| 4,400,182 | A | 8/1983 | Davies et al. |
| 4,407,206 | A | 10/1983 | Bartok et al. |
| 4,412,840 | A | 11/1983 | Goksel |
| 4,428,535 | A | 1/1984 | Venetucci |
| 4,432,773 | A | 2/1984 | Euker, Jr. et al. |
| 4,433,065 | A | 2/1984 | Van Der Burgt et al. |
| 4,436,028 | A | 3/1984 | Wilder |
| 4,436,531 | A | 3/1984 | Estabrook et al. |
| 4,439,210 | A | 3/1984 | Lancet |
| 4,443,415 | A | 4/1984 | Queneau et al. |
| 4,444,568 | A | 4/1984 | Beisswenger et al. |
| 4,459,138 | A | 7/1984 | Soung |
| 4,462,814 | A | 7/1984 | Holmes et al. |
| 4,466,828 | A | 8/1984 | Tamai et al. |
| 4,468,231 | A | 8/1984 | Bartok et al. |
| 4,478,425 | A | 10/1984 | Benko |
| 4,478,725 | A | 10/1984 | Velling et al. |
| 4,482,529 | A | 11/1984 | Chen et al. |
| 4,491,609 | A | 1/1985 | Degel et al. |
| 4,497,784 | A | 2/1985 | Diaz |
| 4,500,323 | A | 2/1985 | Siegfried et al. |
| 4,505,881 | A | 3/1985 | Diaz |
| 4,508,544 | A | 4/1985 | Moss |
| 4,508,693 | A | 4/1985 | Diaz |
| 4,515,604 | A | 5/1985 | Eisenlohr et al. |
| 4,515,764 | A | 5/1985 | Diaz |
| 4,524,050 | A | 6/1985 | Chen et al. |
| 4,540,681 | A | 9/1985 | Kustes et al. |
| 4,541,841 | A | 9/1985 | Reinhardt |
| 4,551,155 | A | 11/1985 | Wood et al. |
| 4,558,027 | A | 12/1985 | McKee et al. |
| 4,572,826 | A | 2/1986 | Moore |
| 4,594,140 | A | 6/1986 | Cheng |
| 4,597,775 | A | 7/1986 | Billimoria et al. |
| 4,597,776 | A | 7/1986 | Ullman et al. |
| 4,604,105 | A | 8/1986 | Aquino et al. |
| 4,609,388 | A | 9/1986 | Adler et al. |
| 4,609,456 | A | 9/1986 | Deschamps et al. |
| 4,617,027 | A | 10/1986 | Lang |
| 4,619,864 | A | 10/1986 | Hendrix et al. |
| 4,620,421 | A | 11/1986 | Brown et al. |
| 4,661,237 | A | 4/1987 | Kimura et al. |
| 4,668,428 | A | 5/1987 | Najjar |

(56) References Cited

U.S. PATENT DOCUMENTS 4,668,429 A 5/1987 Najjar
4,675,035 A 6/1987 Apffel
4,678,480 A 7/1987 Heinrich et al.
4,682,986 A 7/1987 Lee et al.
4,690,814 A 9/1987 Velenyi et al.
4,696,678 A 9/1987 Koyama et al.
4,699,632 A 10/1987 Babu et al.
4,704,136 A 11/1987 Weston et al.
4,720,289 A 1/1988 Vaugh et al.
4,747,938 A 5/1988 Khan
4,781,731 A 11/1988 Schlinger
4,803,061 A 2/1989 Najjar et al.
4,808,194 A 2/1989 Najjar et al.
4,810,475 A 3/1989 Chu et al.
4,822,935 A 4/1989 Scott
4,848,983 A 7/1989 Tomita et al.
4,854,944 A 8/1989 Strong
4,861,346 A 8/1989 Najjar et al.
4,861,360 A 8/1989 Apffel
4,872,886 A 10/1989 Henley et al.
4,876,080 A 10/1989 Paulson
4,892,567 A 1/1990 Yan
4,960,450 A 10/1990 Schwarz et al.
4,995,193 A 2/1991 Soga et al.
5,017,282 A 5/1991 Delbianco et al.
5,055,181 A 10/1991 Maa et al.
5,057,294 A 10/1991 Sheth et al.
5,059,406 A 10/1991 Sheth et al.
5,074,357 A 12/1991 Haines
5,093,094 A 3/1992 Van Kleeck et al.
5,094,737 A 3/1992 Bearden, Jr. et al.
5,132,007 A 7/1992 Meyer et al.
5,223,173 A 6/1993 Jeffrey
5,225,044 A 7/1993 Breu
5,236,557 A 8/1993 Muller et al.
5,242,470 A 9/1993 Salter et al.
5,250,083 A 10/1993 Wolfenbarger et al.
5,277,884 A 1/1994 Shinnar et al.
5,354,345 A 10/1994 Nehls, Jr.
5,388,645 A 2/1995 Puri et al.
5,388,650 A 2/1995 Michael
5,435,940 A 7/1995 Doering et al.
5,536,893 A 7/1996 Gudmundsson
5,566,755 A 10/1996 Seidle et al.
5,616,154 A 4/1997 Elliott et al.
5,630,854 A 5/1997 Sealock, Jr. et al.
5,641,327 A 6/1997 Leas
5,660,807 A 8/1997 Forg et al.
5,669,960 A 9/1997 Couche
5,670,122 A 9/1997 Zamansky et al.
5,720,785 A 2/1998 Baker
5,733,515 A 3/1998 Doughty et al.
5,769,165 A 6/1998 Bross et al.
5,776,212 A 7/1998 Leas
5,788,724 A 8/1998 Carugati et al.
5,855,631 A 1/1999 Leas
5,865,898 A 2/1999 Holtzapple et al.
5,968,465 A 10/1999 Koveal et al.
6,013,158 A 1/2000 Wootten
6,015,104 A 1/2000 Rich, Jr.
6,028,234 A 2/2000 Heinemann et al.
6,032,737 A 3/2000 Brady et al.
6,090,356 A 7/2000 Jahnke et al.
6,119,778 A 9/2000 Seidle et al.
6,132,478 A 10/2000 Tsurui et al.
6,180,843 B1 1/2001 Heinemann et al.
6,187,465 B1 2/2001 Galloway
6,379,645 B1 4/2002 Bucci et al.
6,389,820 B1 5/2002 Rogers et al.
6,419,888 B1 7/2002 Wyckoff
6,506,349 B1 1/2003 Khanmamedov
6,506,361 B1 1/2003 Machado et al.
6,602,326 B2 8/2003 Lee et al.
6,641,625 B1 11/2003 Clawson et al.
6,653,516 B1 11/2003 Yoshikawa et al.
6,692,711 B1 2/2004 Alexion et al.
6,790,430 B1 9/2004 Lackner et al.
6,797,253 B2 9/2004 Lyon
6,808,543 B2 10/2004 Paisley
6,830,597 B1 12/2004 Green
6,855,852 B1 2/2005 Jackson et al.
6,878,358 B2 4/2005 Vosteen et al.
6,894,183 B2 5/2005 Choudhary et al.
6,955,595 B2 10/2005 Kim
6,955,695 B2 10/2005 Nahas
6,969,494 B2 11/2005 Herbst
7,056,359 B1 6/2006 Somerville et al.
7,074,373 B1 7/2006 Warren et al.
7,077,202 B2 7/2006 Shaw et al.
7,100,692 B2 9/2006 Parsley et al.
7,118,720 B1 10/2006 Mendelsohn et al.
7,132,183 B2 11/2006 Galloway
7,168,488 B2 1/2007 Olsvik et al.
7,205,448 B2 4/2007 Gajda et al.
7,220,502 B2 5/2007 Galloway
7,299,868 B2 11/2007 Zapadinski
7,309,383 B2 12/2007 Beech, Jr. et al.
7,481,275 B2 1/2009 Olsvik et al.
7,666,383 B2 2/2010 Green
7,677,309 B2 3/2010 Shaw et al.
7,758,663 B2 7/2010 Rabovitser et al.
7,897,126 B2 3/2011 Rappas et al.
7,901,644 B2 3/2011 Rappas et al.
7,922,782 B2 4/2011 Sheth
7,926,750 B2 4/2011 Hauserman
7,976,593 B2 7/2011 Graham
8,114,176 B2 2/2012 Nahas
8,114,177 B2 2/2012 Hippo et al.
8,123,827 B2 2/2012 Robinson
8,163,048 B2 4/2012 Rappas et al.
8,192,716 B2 6/2012 Raman et al.
8,202,913 B2 6/2012 Robinson et al.
8,268,899 B2 9/2012 Robinson et al.
8,286,901 B2 10/2012 Rappas et al.
8,297,542 B2 10/2012 Rappas et al.
8,328,890 B2 12/2012 Reiling et al.
8,349,037 B2 1/2013 Steiner et al.
8,349,039 B2 1/2013 Robinson
8,361,428 B2 1/2013 Raman et al.
8,366,795 B2 2/2013 Raman et al.
8,479,833 B2 7/2013 Raman
8,479,834 B2 7/2013 Preston
8,502,007 B2 8/2013 Hippo et al.
2002/0036086 A1 3/2002 Minkkinen et al.
2003/0070808 A1 4/2003 Allison
2003/0131582 A1 7/2003 Anderson et al.
2003/0167691 A1 9/2003 Nahas
2004/0020123 A1 2/2004 Kimura et al.
2004/0023086 A1 2/2004 Su et al.
2004/0123601 A1 7/2004 Fan
2004/0180971 A1 9/2004 Inoue et al.
2004/0256116 A1 12/2004 Olsvik et al.
2005/0107648 A1 5/2005 Kimura et al.
2005/0137442 A1 6/2005 Gajda et al.
2005/0192362 A1 9/2005 Rodriguez et al.
2005/0287056 A1 12/2005 Baker et al.
2005/0288537 A1 12/2005 Maund et al.
2006/0149423 A1 7/2006 Barnicki et al.
2006/0228290 A1 10/2006 Green
2006/0231252 A1 10/2006 Shaw et al.
2006/0265953 A1 11/2006 Hobbs
2006/0272813 A1 12/2006 Olsvik et al.
2007/0000177 A1 1/2007 Hippo et al.
2007/0051043 A1 3/2007 Schingnitz
2007/0083072 A1 4/2007 Nahas
2007/0180990 A1 8/2007 Downs et al.
2007/0186472 A1 8/2007 Rabovitser et al.
2007/0220810 A1 9/2007 Leveson et al.
2007/0227729 A1 10/2007 Zubrin et al.
2007/0237696 A1 10/2007 Payton
2007/0277437 A1 12/2007 Sheth
2007/0282018 A1 12/2007 Jenkins
2008/0022586 A1 1/2008 Gilbert et al.
2008/0141591 A1 6/2008 Kohl

(56) References Cited

U.S. PATENT DOCUMENTS

| | | | |
|---|---|---|---|
| 2008/0289822 | A1 | 11/2008 | Betzer Tsilevich |
| 2009/0012188 | A1 | 1/2009 | Rojey et al. |
| 2009/0048476 | A1 | 2/2009 | Rappas et al. |
| 2009/0090055 | A1 | 4/2009 | Ohtsuka |
| 2009/0090056 | A1 | 4/2009 | Ohtsuka |
| 2009/0165361 | A1 | 7/2009 | Rappas et al. |
| 2009/0165376 | A1 | 7/2009 | Lau et al. |
| 2009/0165379 | A1 | 7/2009 | Rappas |
| 2009/0165380 | A1 | 7/2009 | Lau et al. |
| 2009/0165381 | A1 | 7/2009 | Robinson |
| 2009/0165382 | A1 | 7/2009 | Rappas et al. |
| 2009/0165383 | A1 | 7/2009 | Rappas et al. |
| 2009/0165384 | A1 | 7/2009 | Lau et al. |
| 2009/0166588 | A1 | 7/2009 | Spitz et al. |
| 2009/0169448 | A1 | 7/2009 | Rappas et al. |
| 2009/0169449 | A1 | 7/2009 | Rappas et al. |
| 2009/0170968 | A1 | 7/2009 | Nahas et al. |
| 2009/0173079 | A1 | 7/2009 | Wallace et al. |
| 2009/0217575 | A1 | 9/2009 | Raman et al. |
| 2009/0217582 | A1 | 9/2009 | May et al. |
| 2009/0217584 | A1 | 9/2009 | Raman et al. |
| 2009/0217585 | A1 | 9/2009 | Raman et al. |
| 2009/0217586 | A1 | 9/2009 | Rappas et al. |
| 2009/0217587 | A1 | 9/2009 | Raman et al. |
| 2009/0217588 | A1 | 9/2009 | Hippo et al. |
| 2009/0217589 | A1 | 9/2009 | Robinson |
| 2009/0217590 | A1 | 9/2009 | Rappas et al. |
| 2009/0218424 | A1 | 9/2009 | Hauserman |
| 2009/0220406 | A1 | 9/2009 | Rahman |
| 2009/0229182 | A1 | 9/2009 | Raman et al. |
| 2009/0235585 | A1 | 9/2009 | Neels et al. |
| 2009/0236093 | A1 | 9/2009 | Zubrin et al. |
| 2009/0246120 | A1 | 10/2009 | Raman et al. |
| 2009/0259080 | A1 | 10/2009 | Raman et al. |
| 2009/0260287 | A1 | 10/2009 | Lau |
| 2009/0305093 | A1 | 12/2009 | Biollaz et al. |
| 2009/0324458 | A1 | 12/2009 | Robinson et al. |
| 2009/0324459 | A1 | 12/2009 | Robinson et al. |
| 2009/0324460 | A1 | 12/2009 | Robinson et al. |
| 2009/0324461 | A1 | 12/2009 | Robinson et al. |
| 2009/0324462 | A1 | 12/2009 | Robinson et al. |
| 2010/0005710 | A1 | 1/2010 | Shaffer |
| 2010/0018113 | A1 | 1/2010 | Bohlig et al. |
| 2010/0050654 | A1 | 3/2010 | Chiu et al. |
| 2010/0071235 | A1 | 3/2010 | Pan et al. |
| 2010/0071262 | A1 | 3/2010 | Robinson et al. |
| 2010/0076235 | A1 | 3/2010 | Reiling et al. |
| 2010/0120926 | A1 | 5/2010 | Robinson et al. |
| 2010/0121125 | A1 | 5/2010 | Hippo et al. |
| 2010/0159352 | A1 | 6/2010 | Gelin et al. |
| 2010/0168494 | A1 | 7/2010 | Rappas et al. |
| 2010/0168495 | A1 | 7/2010 | Rappas et al. |
| 2010/0179232 | A1 | 7/2010 | Robinson et al. |
| 2010/0287835 | A1 | 11/2010 | Reiling et al. |
| 2010/0287836 | A1 | 11/2010 | Robinson et al. |
| 2010/0292350 | A1 | 11/2010 | Robinson et al. |
| 2011/0031439 | A1 | 2/2011 | Sirdeshpande et al. |
| 2011/0062012 | A1 | 3/2011 | Robinson |
| 2011/0062721 | A1 | 3/2011 | Sirdeshpande et al. |
| 2011/0062722 | A1 | 3/2011 | Sirdeshpande et al. |
| 2011/0064648 | A1 | 3/2011 | Preston et al. |
| 2011/0088896 | A1 | 4/2011 | Preston |
| 2011/0088897 | A1 | 4/2011 | Raman |
| 2011/0146978 | A1 | 6/2011 | Perlman |
| 2011/0146979 | A1 | 6/2011 | Wallace |
| 2011/0197501 | A1 | 8/2011 | Taulbee |
| 2011/0207002 | A1 | 8/2011 | Powell et al. |
| 2011/0217602 | A1 | 9/2011 | Sirdeshpande |
| 2011/0262323 | A1 | 10/2011 | Rappas et al. |
| 2011/0294905 | A1 | 12/2011 | Robinson et al. |
| 2012/0046510 | A1 | 2/2012 | Sirdeshpande |
| 2012/0060417 | A1 | 3/2012 | Raman et al. |
| 2012/0102836 | A1 | 5/2012 | Raman et al. |
| 2012/0102837 | A1 | 5/2012 | Raman et al. |
| 2012/0210635 | A1 | 8/2012 | Edwards |
| 2012/0213680 | A1 | 8/2012 | Rappas et al. |
| 2012/0271072 | A1 | 10/2012 | Robinson et al. |
| 2012/0305848 | A1 | 12/2012 | Sirdeshpande |
| 2013/0042824 | A1 | 2/2013 | Sirdeshpande |
| 2013/0046124 | A1 | 2/2013 | Sirdeshpande |
| 2013/0172640 | A1 | 7/2013 | Robinson et al. |

FOREIGN PATENT DOCUMENTS

| | | |
|---|---|---|
| CA | 1041553 | 10/1978 |
| CA | 1106178 | 8/1981 |
| CA | 1 125 026 | 6/1982 |
| CA | 1187702 | 6/1985 |
| CA | 1282243 | 4/1991 |
| CA | 1299589 | 4/1992 |
| CA | 1332108 | 9/1994 |
| CA | 2673121 | 6/2008 |
| CA | 2713642 | 7/2009 |
| CN | 1477090 | 2/2004 |
| CN | 101555420 | 10/2009 |
| DE | 2 210 891 | 3/1972 |
| DE | 2210891 | 9/1972 |
| DE | 2852710 | 6/1980 |
| DE | 3422202 | 12/1985 |
| DE | 100610607 | 6/2002 |
| EP | 0024792 | 3/1981 |
| EP | 0 067 580 | 12/1982 |
| EP | 102828 | 3/1984 |
| EP | 0 138 463 | 4/1985 |
| EP | 0 225 146 | 6/1987 |
| EP | 0 259 927 | 3/1988 |
| EP | 0473153 | 3/1992 |
| EP | 0 723 930 | 7/1996 |
| EP | 819 | 4/2000 |
| EP | 1001002 | 5/2000 |
| EP | 1004746 | 5/2000 |
| EP | 1136542 | 9/2001 |
| EP | 1 207 132 | 5/2002 |
| EP | 1 741 673 | 6/2006 |
| EP | 1768207 | 3/2007 |
| EP | 2058471 | 5/2009 |
| FR | 797 089 | 4/1936 |
| FR | 2 478 615 | 9/1981 |
| FR | 2906879 | 4/2008 |
| GB | 593910 | 10/1947 |
| GB | 640907 | 8/1950 |
| GB | 676615 | 7/1952 |
| GB | 701 131 | 12/1953 |
| GB | 760627 | 11/1956 |
| GB | 798741 | 7/1958 |
| GB | 820 257 | 9/1959 |
| GB | 996327 | 6/1965 |
| GB | 1033764 | 6/1966 |
| GB | 1448562 | 9/1976 |
| GB | 1453081 | 10/1976 |
| GB | 1467219 | 3/1977 |
| GB | 1467995 | 3/1977 |
| GB | 1 599 932 | 7/1977 |
| GB | 1560873 | 2/1980 |
| GB | 2078251 | 1/1982 |
| GB | 2154600 | 9/1985 |
| GB | 2455864 | 6/2009 |
| JP | 53-94305 | 8/1978 |
| JP | 53-111302 | 9/1978 |
| JP | 54020003 | 2/1979 |
| JP | 54-150402 | 11/1979 |
| JP | 55-12181 | 1/1980 |
| JP | 56-145982 | 11/1981 |
| JP | 56157493 | 12/1981 |
| JP | 60-35092 | 2/1985 |
| JP | 60-77938 | 5/1985 |
| JP | 62241991 | 10/1987 |
| JP | 62 257985 | 11/1987 |
| JP | 03-115491 | 5/1991 |
| JP | 2000290659 | 10/2000 |
| JP | 2000290670 | 10/2000 |
| JP | 2002105467 | 4/2002 |
| JP | 2004292200 | 10/2004 |
| JP | 2004298818 | 10/2004 |

(56) References Cited

FOREIGN PATENT DOCUMENTS

| | | |
|---|---|---|
| JP | 2006 169476 | 6/2006 |
| WO | 00/18681 | 4/2000 |
| WO | 00/43468 | 7/2000 |
| WO | 02/40768 | 5/2002 |
| WO | 02/079355 | 10/2002 |
| WO | 02/103157 | 12/2002 |
| WO | 03/018958 | 3/2003 |
| WO | 03/033624 | 4/2003 |
| WO | 2004/055323 | 7/2004 |
| WO | 2004/072210 | 8/2004 |
| WO | 2006/031011 | 3/2006 |
| WO | 2007/005284 | 1/2007 |
| WO | 2007/047210 | 4/2007 |
| WO | 2007/068682 | 6/2007 |
| WO | 2007/076363 | 7/2007 |
| WO | 2007/077137 | 7/2007 |
| WO | 2007/077138 | 7/2007 |
| WO | 2007/083072 | 7/2007 |
| WO | 2007/128370 | 11/2007 |
| WO | 2007/143376 | 12/2007 |
| WO | 2008/058636 | 5/2008 |
| WO | 2008/073889 | 6/2008 |
| WO | 2008/087154 | 7/2008 |
| WO | 2009/018053 | 2/2009 |
| WO | 2009/048723 | 4/2009 |
| WO | 2009/048724 | 4/2009 |
| WO | 2009/086361 | 7/2009 |
| WO | 2009/086362 | 7/2009 |
| WO | 2009/086363 | 7/2009 |
| WO | 2009/086366 | 7/2009 |
| WO | 2009/086367 | 7/2009 |
| WO | 2009/086370 | 7/2009 |
| WO | 2009/086372 | 7/2009 |
| WO | 2009/086374 | 7/2009 |
| WO | 2009/086377 | 7/2009 |
| WO | 2009/086383 | 7/2009 |
| WO | 2009/086407 | 7/2009 |
| WO | 2009/086408 | 7/2009 |
| WO | 2009/111330 | 9/2009 |
| WO | 2009/111331 | 9/2009 |
| WO | 2009/111332 | 9/2009 |
| WO | 2009/111335 | 9/2009 |
| WO | 2009/111342 | 9/2009 |
| WO | 2009/111345 | 9/2009 |
| WO | 2009/124017 | 10/2009 |
| WO | 2009/124019 | 10/2009 |
| WO | 2009/158576 | 12/2009 |
| WO | 2009/158579 | 12/2009 |
| WO | 2009/158580 | 12/2009 |
| WO | 2009/158582 | 12/2009 |
| WO | 2009/158583 | 12/2009 |
| WO | 2010/033846 | 3/2010 |
| WO | 2010/033848 | 3/2010 |
| WO | 2010/033850 | 3/2010 |
| WO | 2010/033852 | 3/2010 |
| WO | 2010/048493 | 4/2010 |
| WO | 2010/078297 | 7/2010 |
| WO | 2010/078298 | 7/2010 |
| WO | 2010/132549 | 11/2010 |
| WO | 2010/132551 | 11/2010 |
| WO | 2011/017630 | 2/2011 |
| WO | 2011/029278 | 3/2011 |
| WO | 2011/029282 | 3/2011 |
| WO | 2011/029283 | 3/2011 |
| WO | 2011/029284 | 3/2011 |
| WO | 2011/029285 | 3/2011 |
| WO | 2011/034888 | 3/2011 |
| WO | 2011/034889 | 3/2011 |
| WO | 2011/034890 | 3/2011 |
| WO | 2011/034891 | 3/2011 |
| WO | 2011/049858 | 4/2011 |
| WO | 2011/049861 | 4/2011 |
| WO | 2011/063608 | 6/2011 |
| WO | 2011/084580 | 7/2011 |
| WO | 2011/084581 | 7/2011 |
| WO | 2011/106285 | 9/2011 |
| WO | 2011/139694 | 11/2011 |
| WO | 2011/150217 | 12/2011 |
| WO | 2012/024369 | 2/2012 |
| WO | 2012/033997 | 3/2012 |
| WO | 2012/061235 | 5/2012 |
| WO | 2012/061238 | 5/2012 |
| WO | 2012/116003 | 8/2012 |
| WO | 2012/145497 | 10/2012 |
| WO | 2012/166879 | 12/2012 |
| WO | 2013/025808 | 2/2013 |
| WO | 2013/025812 | 2/2013 |
| WO | 2013/052553 | 4/2013 |

OTHER PUBLICATIONS

U.S. Appl. No. 12/778,548, filed May 12, 2010, Robinson, et al.

U.S. Appl. No. 12/778,552, filed May 12, 2010, Robinson, et al.

Asami, K., et al., "Highly Active Iron Catalysts from Ferric Chloride or the Steam Gasification of Brown Coal," ind. Eng. Chem. Res., vol. 32, No. 8, 1993, pp. 1631-1636.

Berger, R. et al., "High Temperature $CO_2$-Absorption: A Process Offering New Prospects in Fuel Chemistry," the Fifth International Symposium on Coal Combustion, Nov. 2003, Nanjing, China, pp. 547-549.

Brown et al., "Biomass-Derived Hydrogen From a Thermally Ballasted Gasifier," Aug. 2005.

Brown et al., "Biomass-Derived Hydrogen From a Thermally Ballasted Gasifier," DOE Hydrogen Program Contractors' Review Metting, Center for Sustainable Environmental Technologies, Iowa State University, May 21, 2003.

Cohen, S.J., Project Manager, "Large Pilot Plant Alternatives for Scaleup of the Catalytic Coal Gasification Process," FE-2480-20, U.S. Dept. of Energy, Contract No., EX-76-C-01-2480, 1979.

Euker, Jr., C.A., Reitz, R.A., Program Managers, "Exxon Catalytic Coal-Gasification-Process Development Program," Exxon Research & Engineering Company, FE-2777-31, U.S. Dept. of Energy, Contract No. ET-78-C-01-2777, 1981.

Kalina, T., Nahas, N.C., Project Managers, "Exxon Catalaytic Coal Gasification Process Predevelopment Program," Exxon Research & Engineering Company, FE-2369-24, U.S. Dept. of Energy, Contract No., E(49-18)-2369, 1978.

Nahas, N.C., "Exxon Catalytic Coal Gasification Process—Fundamentals to Flowsheets," Fuel, vol. 62, No. 2, 1983, pp. 239-241.

Ohtsuka, Y. et al., "Highly Active Catalysts from Inexpensive Raw Materials for Coal Gasification," Catalysis Today, vol. 39, 1997, pp. 111-125.

Ohtsuka, Yasuo et al, "Steam Gasification of Low-Rank Coals with a Chlorine-Free Iron Catalyst from Ferric Chloride," Ind. Eng. Chem. Res., vol. 30, No. 8, 1991, pp. 1921-1926.

Ohtsuka, Yasuo et al., "Calcium Catalysed Steam Gasification of Yalourn Brown Coal," Fuel, vol. 65, 1986, pp. 1653-1657.

Ohtsuka, Yasuo, et al, "Iron-Catalyzed Gasification of Brown Coal at Low Temperatures," Energy & Fuels, vol. 1, No. 1, 1987, pp. 32-36.

Ohtsuka, Yasuo, et al., "Ion-Exchanged Calcium From Calcium Carbonate and Low-Rank Coals: High Catalytic Activity in Steam Gasification," Energy & Fuels 1996, 10, pp. 431-435.

Ohtsuka, Yasuo et al., "Steam Gasification of Coals with Calcium Hydroxide," Energy & Fuels, vol. 9, No. 6, 1995, pp. 1038-1042.

Pereira, P., et al., "Catalytic Steam Gasification of Coals," Energy & Fuels, vol. 6, No. 4, 1992, pp. 407-410.

Ruan Xiang-Quan, et al., "Effects of Catalysis on Gasification of Tatong Coal Char," Fuel, vol. 66, Apr. 1987, pp. 568-571.

Tandon, D., "Low Temperature and Elevated Pressure Steam Gasification of Illinois Coal," College of Engineering in the Graduate School, Southern Illinois university at Carbondale, Jun. 1996.

Adsorption, http://en.wikipedia.org/wiki/Adsorption, pp. 1-8 (Oct. 17, 2007).

Amine gas treating, http://en.wikipedia.org/wiki/Acid_gas_removal, pp. 1-4 (Oct. 21, 2007).

Coal, http://en.wikipedia.org/wiki/Coal_gasification, pp. 1-8 (Oct. 29, 2007).

(56) References Cited

OTHER PUBLICATIONS

Coal Data: A Reference, Energy Information Administration, Office of Coal, Nuclear, Electric, and Alternate Fuels U.S. Department of Energy, DOE/EIA-0064(93), Feb. 1995.
Deepak Tandon, Dissertation Approval, "Low Temperature and Elevated Pressure Steam Gasification of Illinois Coal", Jun. 13, 1996.
Demibras, "Demineralization of Agricultural Residues by Water Leaching", *Energy Sources*, vol. 25, pp. 679-687, (2003).
Fluidized Bed Gasifiers, http://www.energyproducts.com/fluidized_bed_gasifiers.htm, Oct. 2007, pp. 1-5.
Gas separation, http://en.wikipedia.org/wiki/Gas_separation, pp. 1-2 (Feb. 24, 2007).
Gasification, http://en.wikipedia.org/wiki/Gasification, pp. 1-6 (Oct. 29, 2007).
Gallagher, Jr., et al., "Catalytic Goal Gasification for SNG Manufacture", *Energy Research*, vol. 4, pp. 137-147, (1980).
Heinemann, et al., "Fundamental and Exploratory Studies of Catalytic Steam Gasification of Carbonaceous Materials", Final Report Fiscal Years 1985-1994.
Jensen, et al. Removal of K and C1 by leaching of straw char, *Biomass and Bioenergy*, vol. 20, pp. 447-457, (2001).
Mengjie, et al., "A potential renewable energy resource development and utilization of biomass energy", http://www.fao.org.docrep/T4470E/t4470e0n.htm, pp. 1-8 (1994).
Meyers, et al. Fly Ash as a Construction Material for Highways, A Manual. Federal Highway Administration, Report No. FHWA-IP-76-16, Washington, DC, 1976.
Moulton, Lyle K. "Bottom Ash and Boiler Slag", *Proceedings of the Third International Ash Utilization Symposium*, U.S. Bureau of Mines, Information Circular No. 8640, Washington, DC, 1973.
Natural gas processing, http://en.wikipedia.org/wiki/Natural_gas_processing, pp. 1-4 (Oct. 22, 2007).
Natural Gas Processing: The Crucial Link Between Natural Gas Production and its Transportation to Market. Energy Information Administration, Office of Oil and Gas; pp. 1-11, (2006).
Prins, et al., "Exergetic optimisation of a production process of Discher-Tropsch fuels from biomass", *Fuel Processing Technology*, vol. 86, pp. 375-389, (2004).
Reboiler, http://en.wikipedia.org/wiki/Reboiler, pp. 1-4 (Nov. 11, 2007).
What is XPS?, http://ww.nuance.northwestern.edu/KeckII/xps1.asp, 2006, pp. 1-2 (2006).
2.3 Types of gasifiers, http://www.fao.org/docrep/t0512e/T0512e0a.htm, pp. 1-6 (1986).
2.4 Gasification fuels, http://www.fao.org/docrep/t0512e/T0512e0b.htm#TopofPage, pp. 1-8 (1986).
2.5 Design of downdraught gasifiers, http://www.fao.org/docrep/t0512e/T0512e)c.htm#TopOfPage, pp. 1-8 (1986).
2.6 Gas cleaning and cooling, http://www.fao.org/docrep/t0512e0d.htm#TopOFPage, pp. 1-3 (1986).
A.G. Collot et al., "Co-pyrolysis and co-gasification of coal and biomass in bench-scale fixed-bed and fluidized bed reactors", (1999) Fuel 78, pp. 667-679.
Wenkui Zhu et al., "Catalytic gasification of char from co-pyrolysis of coal and biomass", (2008) Fuel Processing Technology, vol. 89, pp. 890-896.
Chiesa P. et al., "Co-Production of hydrogen, electricity and C02 from coal with commercially ready technology. Part A: Performance and emissions", (2005) International Journal of Hydrogen Energy, vol. 30, No. 7, pp. 747-767.
Chiaramonte et al, "Upgrade Coke by Gasification", (1982) Hydrocarbon Processing, vol. 61 (9), pp. 255-257 (Abstract only).
Gerdes, Kristin, et al., "Integrated Gasification Fuel Cell Performance and Cost Assessment," National Energy Technology Laboratory, U.S. Department of Energy, Mar. 27, 2009, pp. 1-26.
Ghosh, S., et al., "Energy Analysis of a Cogeneration Plant Using Coal Gasification and Solid Oxide Fuel Cell," Energy, 2006, vol. 31, No. 2-3, pp. 345-363.
Jeon, S.K., et al., "Characteristics of Steam Hydrogasification of Wood Using a Micro-Batch Reactor," Fuel, 2007, vol. 86, pp. 2817-2823.
Li, Mu, et al., "Design of Highly Efficient Coal-Based Integrated Gasification Fuel Cell Power Plants," Journal of Power Sources, 2010, vol. 195, pp. 5707-5718.
Prins, M.J., et al., "Exergetic Optimisation of a Production Process of Fischer-Tropsch Fuels from Biomass," Fuel Processing Technology, 2005, vol. 86, No. 4, pp. 375-389.
Hydromethanation Process, GreatPoint Energy, Inc., from World Wide Web <http://greatpointenergy.com/ourtechnology.php.> accessed Sep. 5, 2013.
Sigma-Aldrich "Particle Size Conversion Table" (2004); from World Wide Web <http:/www.sigmaaldrich.com/chemistry/learning-center/technical-library/particle-size-conversion.printerview.html>.

AGGLOMERATED PARTICULATE LOW-RANK COAL FEEDSTOCK AND USES THEREOF

CROSS-REFERENCE TO RELATED APPLICATIONS

This application claims priority under 35 U.S.C. §119 from U.S. Provisional Application Ser. Nos. 61/708,104 (filed 1 Oct. 2012) and 61/775,772 (filed 11 Mar. 2013), the disclosures of which are incorporated by reference herein for all purposes as if fully set forth.

This application is related to U.S. application Ser. No. 14/039,321, entitled AGGLOMERATED PARTICULATE LOW-RANK COAL FEEDSTOCK AND USES THEREOF), U.S. application Ser. No. 14/039,454, entitled AGGLOMERATED PARTICULATE LOW-RANK COAL FEEDSTOCK AND USES THEREOF), and U.S. application Ser. No. 14/040,058, entitled USE OF CONTAMINATED LOW-RANK COAL FOR COMBUSTION) all of which are concurrently filed herewith and incorporated by reference herein for all purposes as if fully set forth.

FIELD OF THE INVENTION

The present invention relates generally to processes for preparing agglomerated particulate low-rank coal feedstocks of a particle size suitable for reaction in a fluidized-bed reactor and certain other gasification reactors and, in particular, for coal gasification and combustion applications. The present invention also relates to an integrated coal gasification process including preparing and utilizing such agglomerated particulate low-rank coal feedstocks.

BACKGROUND OF THE INVENTION

In view of numerous factors such as higher energy prices and environmental concerns, the production of value-added products (such as pipeline-quality substitute natural gas, hydrogen, methanol, higher hydrocarbons, ammonia and electrical power) from lower-fuel-value carbonaceous feedstocks (such as petroleum coke, resids, asphaltenes, coal and biomass) is receiving renewed attention.

Such lower-fuel-value carbonaceous feedstocks can be gasified at elevated temperatures and pressures to produce a synthesis gas stream that can subsequently be converted to such value-added products.

"Conventional" gasification processes, such as those based on partial combustion/oxidation and/or steam gasification of a carbon source at elevated temperatures and pressures (thermal gasification), generate syngas (carbon monoxide+hydrogen, lower BTU synthesis gas stream) as the primary product (little or no methane is directly produced). The syngas can be directly combusted for heat energy, and/or can be further processed to produce methane (via catalytic methanation, see reaction (III) below), hydrogen (via water-gas shift, see reaction (II) below) and/or any number of other higher hydrocarbon products.

One advantageous gasification process is hydromethanation, in which the carbonaceous feedstock is converted in a fluidized-bed hydromethanation reactor in the presence of a catalyst source, syngas (carbon monoxide and hydrogen) and steam at moderately-elevated temperatures and pressures to directly produce a methane-enriched synthesis gas stream (medium BTU synthesis gas stream) raw product, which can then also be directly combusted, further processed to enrich the methane content, used to produce hydrogen and/or used to produce any number of other hydrocarbon products.

Such lower-fuel-value carbonaceous feedstocks can alternatively be directly combusted for their heat value, typically for generating steam and electrical energy (directly or indirectly via generated steam).

In the above uses, the raw particulate feedstocks are typically processed by at least grinding to a specified particle size profile (including upper and lower end as well as dp(50) of a particle size distribution) suitable for the particular fluidized-bed or other gasification operation. Typically particle size profiles will depend on the type of bed, fluidization conditions (in the case of fluidized beds, such as fluidizing medium and velocity) and other conditions such as feedstock composition and reactivity, feedstock physical properties (such as density and surface area), reactor pressure and temperature, reactor configuration (such as geometry and internals), and a variety of other factors generally recognized by those of ordinary skill in the relevant art.

"Low-rank" coals are typically softer, friable materials with a dull, earthy appearance. They are characterized by relatively higher moisture levels and relatively lower carbon content, and therefore a lower energy content. Examples of low-rank coals include peat, lignite and sub-bituminous coals. Examples of "high-rank" coals include bituminous and anthracite coals.

In addition to their relatively low heating values, the use of low-ranks coals has other drawbacks. For example, the friability of such coals can lead to high fines losses in the feedstock preparation (grinding and other processing) and in the gasification/combustion of such coals. Such fines must be managed or even disposed of, which usually means an economic and efficiency disadvantage (economic and processing disincentive) to the use of such coals. For very highly friable coals such as lignite, such fines losses can approach or even exceed 50 wt % of the original material. In other words, the processing and use of low-rank coals can result in a loss (or less desired use) of a material percentage of the carbon content in the low-rank coal as mined.

It would, therefore, be desirable to find a way to efficiently process low-rank coals to reduce fines losses in both the feedstock processing and ultimate conversion of such low-rank coal materials in various gasification and combustion processes.

Low-rank coals that contain significant amounts of impurities, such as sodium and chlorine (e.g., NaCl), may actually be unusable in gasification/combustion processes due to the highly corrosive and fouling nature of such components, thus requiring pretreatment to remove such impurities. Typically the addition of such a pretreatment renders the use of sodium and/or chlorine contaminated low-rank coals economically unfeasible.

It would, therefore, be desirable to find a way to more efficiently pretreat these contaminated low-rank coals to removed a substantial portion of at least the inorganic sodium and/or chlorine content.

Low-rank coals may also have elevated ash levels, and thus lower useable carbon content per unit raw feedstock. In addition, elevated silica/alumina levels can bind and interfere with many alkali-metal catalysts used in hydromethanation processes, requiring more stringent (and more highly inefficient) and increased amounts of catalyst recovery and catalyst makeup.

It would, therefore, be desirable to find a way to more efficiently pretreat these low-rank coals to reduce overall ash content and, to the extent possible, reduce the alumina component of ash content.

Also, low-ranks coals tend to have lower bulk density and more variability in individual particle density than high-rank coals, which can create challenges for designing and operating gasification and combustion processes.

It would, therefore, be desirable to find a way to increase both particle density and particle density consistency of low-rank coals, to ultimately improve the operability of processes that utilize such low-rank coals.

SUMMARY OF THE INVENTION

In a first aspect, the present invention provides a process for preparing a free-flowing agglomerated particulate low-rank coal feedstock of a specified particle size distribution, the process comprising the steps of:

(A) selecting a specification for the particle size distribution of the free-flowing agglomerated particulate low-rank coal feedstock, the specification comprising (i) a target dp(50) that is a value in the range of from about 100 microns to about 1000 microns, (ii) a target upper end particle size that is a value greater than the target dp(50), and less than or equal to about 1500 microns, and (iii) a target lower end particle size that is a value less than the target dp(50), and greater than or equal to about 45 microns;

(B) providing a raw particulate low-rank coal feedstock having an initial particle density;

(C) grinding the raw particulate low-rank coal feedstock to a ground dp(50) of from about 2% to about 50% of the target dp(50), to generate a ground low-rank coal feedstock;

(D) pelletizing the ground low-rank coal feedstock with water and a binder to generate free-flowing agglomerated low-rank coal particles having a pelletized dp(50) of from about 90% to about 110% of the target dp(50), and a particle density of at least about 5% greater than the initial particle density, wherein the binder is selected from the group consisting of a water-soluble binder, a water-dispersible binder and a mixture thereof; and (E) removing all or a portion of (i) particles larger than the upper end particle size, (ii) particles smaller than the lower end particle size, or (iii) both (i) and (ii), from the free-flowing agglomerated low-rank coal particles to generate the free-flowing agglomerated low-rank coal feedstock.

In a second aspect, the present invention provides a process for hydromethanating a low-rank coal feedstock to a raw methane-enriched synthesis gas stream comprising methane, carbon monoxide, hydrogen and carbon dioxide, the process comprising the steps of:

(a) preparing a low-rank coal feedstock of a specified particle size distribution;

(b) feeding into the fluidized-bed hydromethanation reactor (i) low-rank coal feedstock prepared in step (a), (ii) steam, (iii) one or both of (1) oxygen and (2) a syngas stream comprising carbon monoxide and hydrogen, and (iv) a hydromethanation catalyst, wherein the hydromethanation catalyst is fed into the fluidized-bed hydromethanation reactor either (1) as part of the low-rank coal feedstock prepared in step (a), or (2) separately from the low-rank coal feedstock prepared in step (a), or (3) both (1) and (2);

(c) reacting low-rank coal feedstock fed into the hydromethanation reactor in step (b) with steam in the presence of carbon monoxide, hydrogen and hydromethanation catalyst, at a temperature of from about 1000° F. (about 538° C.) to about 1500° F. (about 816° C.), and a pressure of from about 400 psig (about 2860 kPa) to about 1000 psig (about 6996 kPa), to generate a raw gas comprising methane, carbon monoxide, hydrogen and carbon dioxide; and (d) removing a stream of the raw gas from the hydromethanation reactor as the raw methane-enriched synthesis gas stream, wherein the raw methane-enriched synthesis gas stream comprises (i) at least about 15 mol % methane based on the moles of methane, carbon dioxide, carbon monoxide and hydrogen in the methane-enriched raw product stream, and (ii) at least about 50 mol % methane plus carbon dioxide based on the moles of methane, carbon dioxide, carbon monoxide and hydrogen in the methane-enriched raw product stream, wherein the low-rank coal feedstock comprises a free-flowing agglomerate particulate low-rank coal feedstock, and step (a) comprises the steps of:

(A1) selecting a specification for the particle size distribution of the free-flowing agglomerated particulate low-rank coal feedstock, the specification comprising (i) a target dp(50) that is a value in the range of from about 100 microns to about 1000 microns, (ii) a target upper end particle size that is a value greater than the target dp(50), and less than or equal to about 1500 microns, and (iii) a target lower end particle size that is a value less than the target dp(50), and greater than or equal to about 45 microns;

(B1) providing a raw particulate low-rank coal feedstock having an initial particle density;

(C1) grinding the raw particulate low-rank coal feedstock to a ground dp(50) of from about 2% to about 50% of the target dp(50), to generate a ground low-rank coal feedstock;

(D1) pelletizing the ground low-rank coal feedstock with water and a binder to generate free-flowing agglomerated low-rank coal particles having a pelletized dp(50) of from about 90% to about 110% of the target dp(50), and a particle density of at least about 5% greater than the initial particle density, wherein the binder is selected from the group consisting of a water-soluble binder, a water-dispersible binder and a mixture thereof; and (E1) removing all or a portion of (i) particles larger than the upper end particle size, (ii) particles smaller than the lower end particle size, or (iii) both (i) and (ii), from the free-flowing agglomerated low-rank coal particles to generate the free-flowing agglomerated low-rank coal feedstock.

The processes in accordance with the present invention are useful, for example, for more efficiently producing higher-value products and by-products from various low-rank coal materials at a reduced capital and operating intensity, and greater overall process efficiency.

These and other embodiments, features and advantages of the present invention will be more readily understood by those of ordinary skill in the art from a reading of the following detailed description.

DETAILED DESCRIPTION

Figure 1:
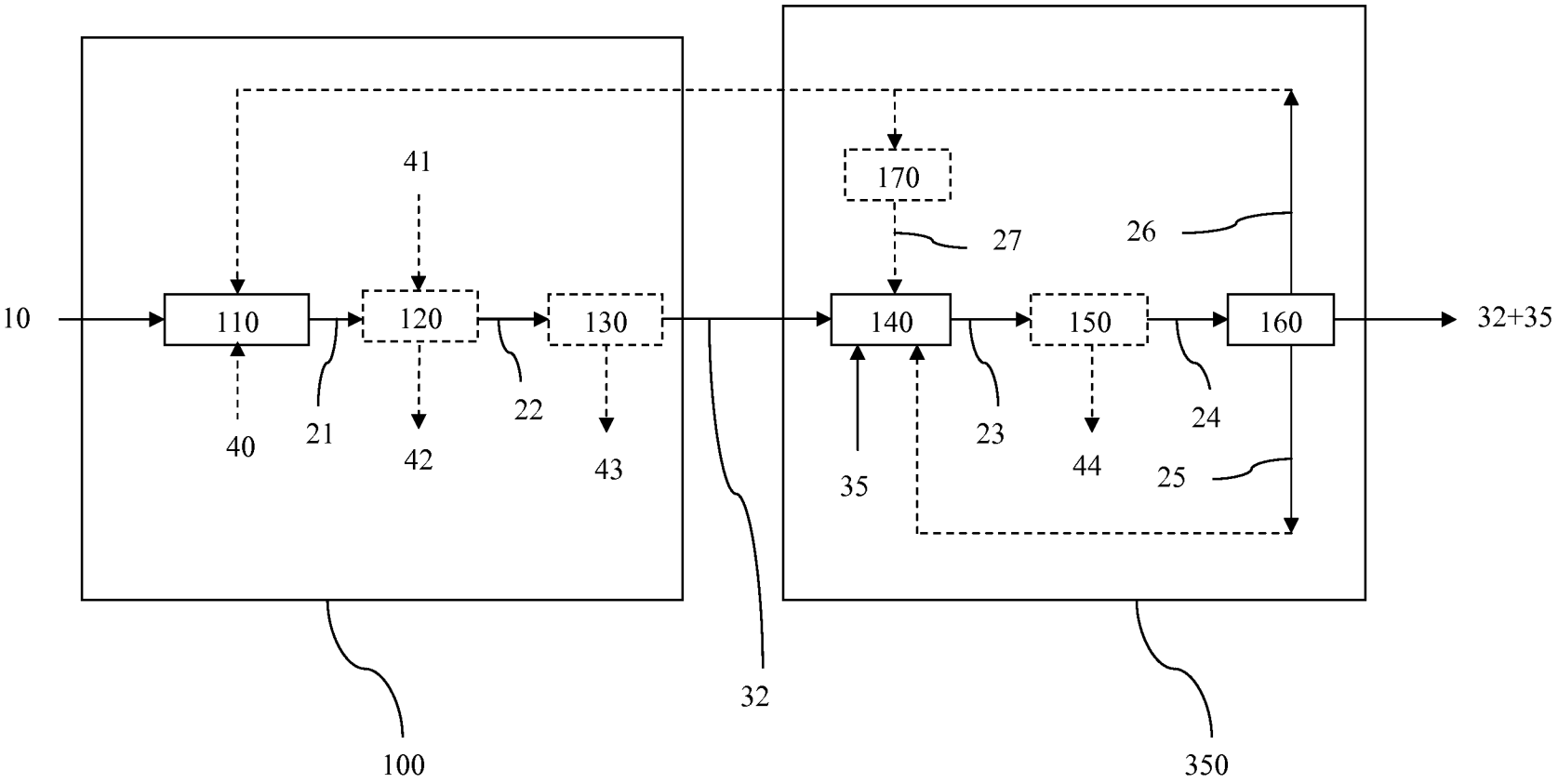
FIG. 1 is a general diagram of an embodiment of a process for preparing a free-flowing agglomerated particulate low-rank coal feedstock in accordance with the first aspect present invention.

The present invention relates to processes for preparing feedstocks from low-rank coals that are suitable for use in certain gasification and combustion processes, and for converting those feedstocks ultimately into one or more value-added products. Further details are provided below.

In the context of the present description, all publications, patent applications, patents and other references mentioned herein, if not otherwise indicated, are explicitly incorporated by reference herein in their entirety for all purposes as if fully set forth.

Unless otherwise defined, all technical and scientific terms used herein have the same meaning as commonly understood by one of ordinary skill in the art to which this disclosure belongs. In case of conflict, the present specification, including definitions, will control.

Except where expressly noted, trademarks are shown in upper case.

Unless stated otherwise, all percentages, parts, ratios, etc., are by weight.

Unless stated otherwise, pressures expressed in psi units are gauge, and pressures expressed in kPa units are absolute. Pressure differences, however, are expressed as absolute (for example, pressure 1 is 25 psi higher than pressure 2).

When an amount, concentration, or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the endpoints thereof, and all integers and fractions within the range. It is not intended that the scope of the present disclosure be limited to the specific values recited when defining a range.

When the term "about" is used in describing a value or an end-point of a range, the disclosure should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but can include other elements not expressly listed or inherent to such process, method, article, or apparatus.

Further, unless expressly stated to the contrary, "or" and "and/or" refers to an inclusive and not to an exclusive. For example, a condition A or B, or A and/or B, is satisfied by any one of the following: A is true (or present) and B is false (or not present), A is false (or not present) and B is true (or present), and both A and B are true (or present).

The use of "a" or "an" to describe the various elements and components herein is merely for convenience and to give a general sense of the disclosure. This description should be read to include one or at least one and the singular also includes the plural unless it is obvious that it is meant otherwise.

The term "substantial", as used herein, unless otherwise defined herein, means that greater than about 90% of the referenced material, preferably greater than about 95% of the referenced material, and more preferably greater than about 97% of the referenced material. If not specified, the percent is on a molar basis when reference is made to a molecule (such as methane, carbon dioxide, carbon monoxide and hydrogen sulfide), and otherwise is on a weight basis (such as for carbon content).

The term "predominant portion", as used herein, unless otherwise defined herein, means that greater than 50% of the referenced material. If not specified, the percent is on a molar basis when reference is made to a molecule (such as hydrogen, methane, carbon dioxide, carbon monoxide and hydrogen sulfide), and otherwise is on a weight basis (such as for carbon content).

The term "depleted" is synonymous with reduced from originally present. For example, removing a substantial portion of a material from a stream would produce a material-depleted stream that is substantially depleted of that material. Conversely, the term "enriched" is synonymous with greater than originally present.

The term "carbonaceous" as used herein is synonymous with hydrocarbon.

The term "carbonaceous material" as used herein is a material containing organic hydrocarbon content. Carbonaceous materials can be classified as biomass or non-biomass materials as defined herein.

The term "biomass" as used herein refers to carbonaceous materials derived from recently (for example, within the past 100 years) living organisms, including plant-based biomass and animal-based biomass. For clarification, biomass does not include fossil-based carbonaceous materials, such as coal. For example, see US2009/0217575A1, US2009/0229182A1 and US2009/0217587A1.

The term "plant-based biomass" as used herein means materials derived from green plants, crops, algae, and trees, such as, but not limited to, sweet sorghum, bagasse, sugarcane, bamboo, hybrid poplar, hybrid willow, albizia trees, eucalyptus, alfalfa, clover, oil palm, switchgrass, sudangrass, millet, jatropha, and *miscanthus* (e.g., *Miscanthus×giganteus*). Biomass further include wastes from agricultural cultivation, processing, and/or degradation such as corn cobs and husks, corn stover, straw, nut shells, vegetable oils, canola oil, rapeseed oil, biodiesels, tree bark, wood chips, sawdust, and yard wastes.

The term "animal-based biomass" as used herein means wastes generated from animal cultivation and/or utilization. For example, biomass includes, but is not limited to, wastes from livestock cultivation and processing such as animal manure, guano, poultry litter, animal fats, and municipal solid wastes (e.g., sewage).

The term "non-biomass", as used herein, means those carbonaceous materials which are not encompassed by the term "biomass" as defined herein. For example, non-biomass includes, but is not limited to, anthracite, bituminous coal, sub-bituminous coal, lignite, petroleum coke, asphaltenes, liquid petroleum residues or mixtures thereof. For example, see US2009/0166588A1, US2009/0165379A1, US2009/0165380A1, US2009/0165361A1, US2009/0217590A1 and US2009/0217586A1.

"Liquid heavy hydrocarbon materials" are viscous liquid or semi-solid materials that are flowable at ambient conditions or can be made flowable at elevated temperature conditions. These materials are typically the residue from the processing of hydrocarbon materials such as crude oil. For example, the first step in the refining of crude oil is normally a distillation to separate the complex mixture of hydrocarbons into fractions of differing volatility. A typical first-step distillation requires heating at atmospheric pressure to vaporize as much of the hydrocarbon content as possible without exceeding an actual temperature of about 650° F. (about 343°

C.), since higher temperatures may lead to thermal decomposition. The fraction which is not distilled at atmospheric pressure is commonly referred to as "atmospheric petroleum residue". The fraction may be further distilled under vacuum, such that an actual temperature of up to about 650° F. (about 343° C.) can vaporize even more material. The remaining undistillable liquid is referred to as "vacuum petroleum residue". Both atmospheric petroleum residue and vacuum petroleum residue are considered liquid heavy hydrocarbon materials for the purposes of the present invention.

Non-limiting examples of liquid heavy hydrocarbon materials include vacuum resids; atmospheric resids; heavy and reduced petroleum crude oils; pitch, asphalt and bitumen (naturally occurring as well as resulting from petroleum refining processes); tar sand oil; shale oil; bottoms from catalytic cracking processes; coal liquefaction bottoms; and other hydrocarbon feedstreams containing significant amounts of heavy or viscous materials such as petroleum wax fractions.

The term "asphaltene" as used herein is an aromatic carbonaceous solid at room temperature, and can be derived, for example, from the processing of crude oil and crude oil tar sands. Asphaltenes may also be considered liquid heavy hydrocarbon feedstocks.

The liquid heavy hydrocarbon materials may inherently contain minor amounts of solid carbonaceous materials, such as petroleum coke and/or solid asphaltenes, that are generally dispersed within the liquid heavy hydrocarbon matrix, and that remain solid at the elevated temperature conditions utilized as the feed conditions for the present process.

The terms "petroleum coke" and "petcoke" as used herein include both (i) the solid thermal decomposition product of high-boiling hydrocarbon fractions obtained in petroleum processing (heavy residues—"resid petcoke"); and (ii) the solid thermal decomposition product of processing tar sands (bituminous sands or oil sands—"tar sands petcoke"). Such carbonization products include, for example, green, calcined, needle and fluidized bed petcoke.

Resid petcoke can also be derived from a crude oil, for example, by coking processes used for upgrading heavy-gravity residual crude oil (such as a liquid petroleum residue), which petcoke contains ash as a minor component, typically about 1.0 wt % or less, and more typically about 0.5 wt % of less, based on the weight of the coke. Typically, the ash in such lower-ash cokes predominantly comprises metals such as nickel and vanadium.

Tar sands petcoke can be derived from an oil sand, for example, by coking processes used for upgrading oil sand. Tar sands petcoke contains ash as a minor component, typically in the range of about 2 wt % to about 12 wt %, and more typically in the range of about 4 wt % to about 12 wt %, based on the overall weight of the tar sands petcoke. Typically, the ash in such higher-ash cokes predominantly comprises materials such as silica and/or alumina.

Petroleum coke can comprise at least about 70 wt % carbon, at least about 80 wt % carbon, or at least about 90 wt % carbon, based on the total weight of the petroleum coke. Typically, the petroleum coke comprises less than about 20 wt % inorganic compounds, based on the weight of the petroleum coke.

The term "coal" as used herein means peat, lignite, sub-bituminous coal, bituminous coal, anthracite, or mixtures thereof. In certain embodiments, the coal has a carbon content of less than about 85%, or less than about 80%, or less than about 75%, or less than about 70%, or less than about 65%, or less than about 60%, or less than about 55%, or less than about 50% by weight, based on the total coal weight. In other embodiments, the coal has a carbon content ranging up to about 85%, or up to about 80%, or up to about 75% by weight, based on the total coal weight. Examples of useful coal include, but are not limited to, Illinois #6, Pittsburgh #8, Beulah (ND), Utah Blind Canyon, and Powder River Basin (PRB) coals. Anthracite, bituminous coal, sub-bituminous coal, and lignite coal may contain about 10 wt %, from about 5 to about 7 wt %, from about 4 to about 8 wt %, and from about 9 to about 11 wt %, ash by total weight of the coal on a dry basis, respectively. However, the ash content of any particular coal source will depend on the rank and source of the coal, as is familiar to those skilled in the art. See, for example, "Coal Data: A Reference", Energy Information Administration, Office of Coal, Nuclear, Electric and Alternate Fuels, U.S. Department of Energy, DOE/EIA-0064(93), February 1995.

The ash produced from combustion of a coal typically comprises both a fly ash and a bottom ash, as is familiar to those skilled in the art. The fly ash from a bituminous coal can comprise from about 20 to about 60 wt % silica and from about 5 to about 35 wt % alumina, based on the total weight of the fly ash. The fly ash from a sub-bituminous coal can comprise from about 40 to about 60 wt % silica and from about 20 to about 30 wt % alumina, based on the total weight of the fly ash. The fly ash from a lignite coal can comprise from about 15 to about 45 wt % silica and from about 20 to about 25 wt % alumina, based on the total weight of the fly ash. See, for example, Meyers, et al. "Fly Ash. A Highway Construction Material," Federal Highway Administration, Report No. FHWA-IP-76-16, Washington, D.C., 1976.

The bottom ash from a bituminous coal can comprise from about 40 to about 60 wt % silica and from about 20 to about 30 wt % alumina, based on the total weight of the bottom ash. The bottom ash from a sub-bituminous coal can comprise from about 40 to about 50 wt % silica and from about 15 to about 25 wt % alumina, based on the total weight of the bottom ash. The bottom ash from a lignite coal can comprise from about 30 to about 80 wt % silica and from about 10 to about 20 wt % alumina, based on the total weight of the bottom ash. See, for example, Moulton, Lyle K. "Bottom Ash and Boiler Slag," Proceedings of the Third International Ash Utilization Symposium, U.S. Bureau of Mines, Information Circular No. 8640, Washington, D.C., 1973.

A material such as methane can be biomass or non-biomass under the above definitions depending on its source of origin.

A "non-gaseous" material is substantially a liquid, semi-solid, solid or mixture at ambient conditions. For example, coal, petcoke, asphaltene and liquid petroleum residue are non-gaseous materials, while methane and natural gas are gaseous materials.

The term "unit" refers to a unit operation. When more than one "unit" is described as being present, those units are operated in a parallel fashion unless otherwise stated. A single "unit", however, may comprise more than one of the units in series, or in parallel, depending on the context. For example, a cyclone unit may comprise an internal cyclone followed in series by an external cyclone. As another example, a pelletizing unit may comprise a first pelletizer to pelletize to a first particle size/particle density, followed in series by a second pelletizer to pelletize to a second particle size/particle density.

The term "free-flowing" particles as used herein means that the particles do not materially agglomerate (for example, do not materially aggregate, cake or clump) due to moisture content, as is well understood by those of ordinary skill in the relevant art. Free-flowing particles need not be "dry" but, desirably, the moisture content of the particles is substantially internally contained so that there is minimal (or no) surface moisture.

The term "a portion of the carbonaceous feedstock" refers to carbon content of unreacted feedstock as well as partially reacted feedstock, as well as other components that may be derived in whole or part from the carbonaceous feedstock (such as carbon monoxide, hydrogen and methane). For example, "a portion of the carbonaceous feedstock" includes carbon content that may be present in by-product char and recycled fines, which char is ultimately derived from the original carbonaceous feedstock.

The term "superheated steam" in the context of the present invention refers to a steam stream that is non-condensing under the conditions utilized, as is commonly understood by persons of ordinary skill in the relevant art.

The term "dry saturated steam" or "dry steam" in the context of the present invention refers to slightly superheated saturated steam that is non-condensing, as is commonly understood by persons of ordinary skill in the relevant art.

The term "HGI" refers to the Hardgrove Grinding Index as measured in accordance with ASTM D409/D409M-11ae1.

The term "dp(50)" refers to the mean particle size of a particle size distribution as measured in accordance with ASTM D4749-87 (2007).

The term "particle density" refers to particle density as measured by mercury intrusion porosimetry in accordance with ASTM D4284-12.

When describing particles sizes, the use of "+" means greater than or equal to (e.g., approximate minimum), and the use of "−" means less than or equal to (e.g., approximate maximum).

Although methods and materials similar or equivalent to those described herein can be used in the practice or testing of the present disclosure, suitable methods and materials are described herein. The materials, methods, and examples herein are thus illustrative only and, except as specifically stated, are not intended to be limiting.

General Feedstock Preparation Process Information

The present invention in part is directed to various processes for preparing free-flowing agglomerated particulate low-rank coal feedstocks suitable for fluidized-bed applications, including gasification and combustions processes, as well as certain other fixed/moving bed gasification processes.

Typically, in accordance with the present invention, the particle size distribution of such feedstocks for fluidized-bed uses will have a dp(50) that falls broadly within the range of from about 100 microns to about 1000 microns. Different fluidized-bed processes will have their own more narrow ranges of particle size distributions, as discussed in more detail below.

The present invention provides in step (A) the setting of the desired final particle size distribution for the end use of the ultimate free-flowing agglomerated particulate low-rank coal feedstock, including the target dp(50), target upper end particle size (large or "bigs") and target lower end particle size (small or "fines"). Typically, the target upper end particle size should be at least about 200%, or at least three about 300%, and in some cases up to about 1000%, of the target dp(50), but less than or equal to about 1500 microns; while the target lower end particle size should be no greater than about 50%, or no greater than about 33%, and in some cases no less than about 10%, of the target dp(50), but greater than or equal to about 45 microns (about 325 mesh).

A person of ordinary skill in the relevant end-use art will readily be able to determine the desired particle size profile for the desired end use. For example, the desired particle size profile for certain gasification and combustion processes is detailed below.

In step (B) the raw particulate low-rank coal feedstock is provided.

The term "low-rank coal" is generally understood by those of ordinary skill in the relevant art. Low-rank coals include typical sub-bituminous coals, as well as lignites and peats. Low-ranks coals are generally considered to be "younger" coals than high-rank bituminous coal and anthracite, and tend to have lower particle density, higher porosity, lower fixed carbon content, higher moisture content, higher volatile content and, in many cases, higher inorganic ash content than such high rank coals.

In one embodiment, a raw "low-rank coal" has an inherent (total) moisture content of about 25 wt % or greater (as measured in accordance with ASTM D7582-10e1), a heating value of about 6500 kcal/kg (dry basis) or less (as measured in accordance with ASTM D5865-11a), and a fixed carbon content of about 45 wt % or less (as measured in accordance with ASTM D7582-10e1).

Typically, the raw low-rank particulate coal feedstocks will have an HGI of about 50 or greater. An embodiment of a low-rank coal for use in the present invention is a raw coal with an HGI of about 70 or greater, or from about 70 to about 130. In one embodiment, the low-rank coal is a lignite.

Typically, the raw particulate low-rank coal feedstock for use in the present processes will be substantially low-rank coal, or only low-rank coal. Mixtures of two or more different low-rank coals may also be used.

Mixtures of a predominant amount one or more low-rank coals with a minor amount of one or more other non-gaseous carbonaceous feedstocks may also be used as the raw particulate low-rank coal feedstock. Such other non-gaseous feedstocks include, for example, high-rank coals, petroleum coke, liquid petroleum residues, asphaltenes and biomass. In the event of a combination of a low-rank coal with another type of non-gaseous carbonaceous material, to be considered a "raw particulate low-rank coal feedstock" for the purposes of the present invention, the heating value from the low-rank coal component must be the predominant portion of the combination. Expressed another way, the overall heating value of the raw particulate low-rank coal feedstock is greater than 50%, or greater than about 66%, or greater than about 75%, or greater than about 90%, from a low-rank coal source.

As discussed in more detail below, certain other non-gaseous carbonaceous materials may be added at various other steps in the process. For example, such materials may be used to assist in the pelletizing (binding) of the ground low-rank coal feedstock, such as liquid petroleum residues, asphaltenes and certain biomasses such as chicken manure.

The raw low-rank coal feedstock provided in step (B) is then processed by grinding to a small particle size, pelletizing to the desired end particle size and then a final sizing, an embodiment of which is depicted in FIG. 1.

In accordance with that embodiment, a raw particulate low-rank coal feedstock (10) is processed in a feedstock preparation unit (100) to generate a ground low-rank coal feedstock (32), which is combined with a binder (35), pelletized and finally sized in a pelletization unit (350), to generate the free-flowing agglomerated low-rank coal feedstock (32+35) in accordance with the present invention.

Feedstock preparation unit (100) utilizes a grinding step, and may utilize other optional operations including but not limited to a washing step to remove certain impurities from the ground low-rank, and a dewatering step to adjust the water content for subsequent pelletization.

In the grinding step, the raw low-rank coal feedstock (10) can be crushed, ground and/or pulverized in a grinding unit (110) according to any methods known in the art, such as impact crushing and wet or dry grinding to yield a raw ground low-rank coal feedstock (21) of a particle size suitable for subsequent pelletization, which is typically to dp(50) of from about 2%, or from about 5%, or from about 10%, up to about 50%, or to about 40%, or to about 33%, or to about 25%, of the ultimate target dp(50).

The particulate raw low-rank coal feedstock (10) as provided to the grinding step may be as taken directly from a mine or may be initially processed, for example, by a coarse crushing to a particle size sufficiently large to be more finely ground in the grinding step.

Unlike typical coal grinding processes, the ground low-rank coal feedstock (21) is not sized directly after grinding to remove fines, but is used as ground for subsequent pelletization. In other words, in accordance with the present invention, the raw particulate low-rank coal feedstock (10) is completely ground down to a smaller particle size then reconstituted (agglomerated) up to the target particle size.

The present process thus utilizes substantially all (about 90 wt % or greater, or about 95 wt % or greater, or about 98 wt % or greater) of the carbon content of the particulate raw low-rank coal feedstock (10), as opposed to separating out fine or coarse material that would otherwise need to be separately processed (or disposed of) in conventional grinding operations. In other words, the ultimate free-flowing agglomerated particulate low-rank coal feedstock contains about 90 wt % or greater, or about 95 wt % or greater, or about 98 wt % or greater, of the carbon content of the raw particulate low-rank coal feedstock (10), and there is virtually complete usage of the carbon content (heating value) of the particulate raw low-rank coal feedstock (10) brought into the process.

In one embodiment, the particulate raw low-rank coal feedstock (10) is wet ground by adding an aqueous medium (40) into the grinding process. Examples of suitable methods for wet grinding of coal feedstocks are well known to those of ordinary skilled in the relevant art.

In another embodiment, an acid is added in the wet grinding process in order to break down at least a portion of the inorganic ash that may be present in the particulate raw low-rank coal feedstock (10), rendering those inorganic ash components water-soluble so that they can be removed in a subsequent wash stage (as discussed below). This is particularly useful for preparing feedstocks for hydromethanation and other catalytic processes, as certain of the ash components (for example, silica and alumina) may bind the alkali metal catalysts that are typically used for hydromethanation, rendering those catalysts inactive. Suitable acids include hydrochloric acid, sulfuric acid and nitric acid, and are typically utilized in minor amounts sufficient to lower the pH of the aqueous grinding media to a point where the detrimental ash components will at least partially dissolve.

The raw ground low-rank coal feedstock (21) may then optionally be sent to a washing unit (120) where it is contacted with an aqueous medium (41) to remove various water-soluble contaminants, which are withdrawn as a wastewater stream (42), and generate a washed ground low-rank coal feedstock (22). The washing step is particularly useful for treating coals contaminated with inorganic sodium and/or inorganic chlorine (for example, with high NaCl content), as both sodium and chlorine are highly detrimental contaminants in gasification and combustion processes, as well as removing ash constituents that may have been rendered water soluble via the optional acid treatment in the grinding stage (as discussed above).

Examples of suitable coal washing processes are well known to those of ordinary skill in the relevant art. One such process involves utilizing one or a series of vacuum belt filters, where the ground coal is transported on a vacuum belt while it is sprayed with an aqueous medium, typically recycle water recovered from the treatment of wastewater streams from the process (for example, wastewater stream (42)). Additives such as surfactants, flocculants and pelletizing aids can also be applied at this stage. For example, surfactants and flocculants can be applied to assist in dewatering in the vacuum belt filters and/or any subsequent dewatering stages.

The resulting washed ground low-rank coal feedstock (22) will typically be in the form of a wet filter cake or concentrated slurry with a water content that will typically require an additional dewatering stage (dewatering unit (130)) to remove a portion of the water content and generate a ground low-rank coal feedstock (32) having a water content suitable for the subsequent pelletization in pelletization unit (350).

Methods and equipment suitable for dewatering wet coal filter cakes and concentrated coal slurries in this dewatering stage are well-known to those of ordinary skill in the relevant art and include, for example, filtration (gravity or vacuum), centrifugation, fluid press and thermal drying (hot air and/or steam) methods and equipment. Hydrophobic organic compounds and solvents having an affinity for the coal particles can be used to promote dewatering.

A wastewater steam (43) generated from the dewatering stage can, for example, be recycled to washing unit (120) and/or sent for wastewater treatment. Any water recovered from treatment of wastewater stream (43) can be recycled for use elsewhere in the process.

The result from feedstock preparation unit (100) is a ground low-rank coal feedstock (32) of an appropriate particle size and moisture content suitable for pelletization and further processing in pelletization unit (350).

Figure 2:
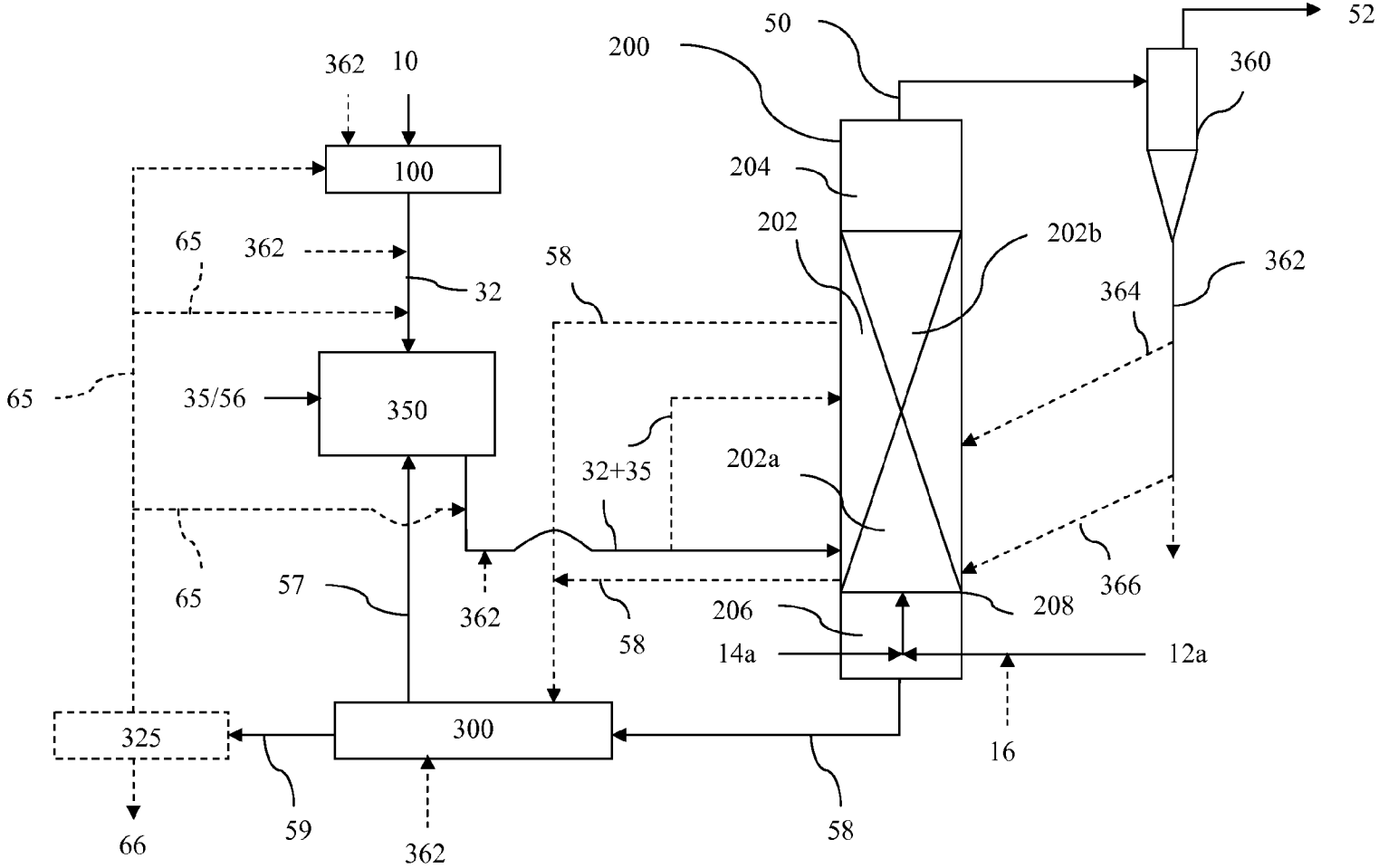
FIG. 2 is a general diagram of an embodiment of a hydromethanation process in accordance with the present invention.

Additional fines materials of appropriate particle size from other sources (not depicted) can be added into the feedstock preparation unit (100) at various places, and/or combined with ground low-rank coal feedstock (32). For example, fines materials from other coal and/or petcoke processing operations can be combined with ground low-rank coal feedstock (32) to modify (e.g., further reduce) the water content of ground low-rank coal feedstock (32) and/or increase the carbon content of the same. As another example, partially converted fines recovered from the raw gas product of a gasification process can be recycled into the feedstock preparation stage in this manner (such as depicted in FIG. 2 discussed below, either before or after catalyst recovery, like recovered fines stream (362)).

Pelletization unit (350) utilizes a pelletizing step and a final sizing step, and may utilize other optional operations including but not limited to a dewatering step to adjust the water content for ultimate use.

Pelletizing step utilizes a pelletizing unit (140) to agglomerate the ground low-rank coal feedstock (32) in an aqueous environment with the aid of a binder (35) that is water-soluble or water-dispersible. The agglomeration is mechanically performed by any one or combination of pelletizers well known to those of ordinary skill in the relevant art. Examples of such pelletizers include pin mixers, disc pelletizers and drum pelletizers. In one embodiment, the pelletization is a two-stage pelletization performed by a first type of pelletizer followed in series by a second type of pelletizer, for example a pin mixer followed by a disc and/or drum pelletizer, which combination allows better control of ultimate particle size and densification of the agglomerated low-rank coal particles.

Suitable binders are also well-known to those of ordinary skill in the relevant art and include organic and inorganic binders. Organic binders include, for example, various starches, flocculants, natural and synthetic polymers, biomass such as chicken manure, and dispersed/emulsified oil materials such as a dispersed liquid petroleum residue.

Inorganic binders include mineral binders. In one embodiment, the binder material is an alkali metal which is provided as an alkali metal compound, and particularly a potassium compound such as potassium hydroxide and/or potassium carbonate, which is particularly useful in hydromethanation processes as the alkali metal serves as the catalyst for those reactions (discussed below). In those hydromethanation processes where the alkali metal catalyst is recovered and recycled, the binder can comprise recycled alkali metal compounds along with makeup catalyst as required.

The pelletizing step should result in wet agglomerated low-rank coal particles (23) having a dp(50) as close to the target dp(50) as possible, but generally at least in the range of from about 90% to about 110% of the target dp(50). Desirably the wet agglomerated low-rank coal particles (23) have a dp(50) in the range of from about 95% to about 105% of the target dp(50).

Depending on the moisture content of the wet agglomerated low-rank coal particles (23), those particles may or may not be free flowing, and/or may not be structurally stable, and/or may have too high a moisture content for the desired end use, and may optionally need to go through an additional dewatering stage in a dewatering unit (150) to generate a dewatered agglomerated low-rank coal feedstock (24). Methods suitable for dewatering the wet agglomerated low-rank coal particles (32) in dewatering stage are well-known to those of ordinary skill in the relevant art and include, for example, filtration (gravity or vacuum), centrifugation, fluid press and thermal drying (hot air and/or steam). In one embodiment, the wet agglomerated low-rank coal particles (23) are thermally dried, desirably with dry or superheated steam.

A wastewater stream (44) generated from the dewatering stage can, for example, be recycled to pelletizing step (140) (along with binder (35)) and/or sent for wastewater treatment. Any water recovered from treatment of wastewater stream (44) can be recycled for use elsewhere in the process.

The pelletization unit (350) includes a final sizing stage in a sizing unit (160), where all or a portion of particles above a target upper end size (large or "bigs") and below a target lower end particle size (fines or "smalls") are removed to result in the free-flowing agglomerated low-rank coal feedstock (32+35). Methods suitable for sizing are generally known to those of ordinary skill in the relevant art, and typically include screening units with appropriately sized screens. In one embodiment, at least 90 wt %, or at least 95 wt %, of either or both (desirably) of the bigs and smalls are removed in this final sizing stage.

In order to maximize carbon usage and minimize waste, the particles above the target upper end size are desirably recovered as stream (26) and recycled directly back to grinding unit (110), and/or may be ground in a separate grinding unit (170) to generate a ground bigs stream (27) which can be recycled directly back into pelletizing unit (140). Likewise, the particles below the target lower end size are desirably recovered as stream (25) and recycled directly back to pelletizing unit (140).

Other than any thermal drying, all operations in the feedstock preparation stage generally take place under ambient temperature and pressure conditions. In one embodiment, however, the washing stage can take place under elevated temperature conditions (for example, using heated wash water) to promote dissolution of contaminants being remove during the washing process.

The resulting free-flowing agglomerated low-rank coal feedstock (32+35) will advantageously have increased particle density as compared to the initial particle density of the raw particulate low rank feedstock. The resulting particle density should be at least about 5% greater, or at least about 10% greater, than the initial particle density of the raw particulate low rank feedstock.

Gasification and Combustion Processes

Processes that can utilize the agglomerated low-rank coal feedstocks in accordance with the present invention include, for example, various gasification and fluidized-bed combustion processes.

(1) Gasification

As a general concept, gasification processes convert the carbon in a carbonaceous feedstock to a raw synthesis gas stream that will generally contain carbon monoxide and hydrogen, and may also contain various amounts of methane and carbon dioxide depending on the particular gasification process. The raw synthesis gas stream may also contain other components such as unreacted steam, hydrogen sulfide, ammonia and other contaminants again depending on the particular gasification process, as well as any co-reactants and feedstocks utilized.

The raw synthesis gas stream is generated in a gasification reactor. Suitable gasification technologies are generally known to those of ordinary skill in the relevant art, and many applicable technologies are commercially available. Such gasification technologies typically utilize fluidized bed and fixed (moving) bed systems.

Hydromethanation is a species of the generic gasification processes.

Hydromethanation processes and the conversion/utilization of the resulting methane-rich synthesis gas stream to produce value-added products are disclosed, for example, in U.S. Pat. No. 3,998,607, U.S. Pat. No. 4,057,512, U.S. Pat. No. 4,094,650, U.S. Pat. No. 4,204,843, U.S. Pat. No. 4,243,639, U.S. Pat. No. 4,292,048, U.S. Pat. No. 4,318,712, U.S. Pat. No. 4,336,034, U.S. Pat. No. 4,558,027, U.S. Pat. No. 4,604,105, U.S. Pat. No. 6,955,695, US2003/0167691A1, US2007/083072A1, US2007/0277437A1, US2009/0048476A1, US2009/0090056A1, US2009/0090055A1, US2009/0165383A1, US2009/0166588A1, US2009/0165379A1, US2009/0170968A1, US2009/0165380A1, US2009/0165381A1, US2009/0165361A1, US2009/0165382A1, US2009/0169449A1, US2009/0169448A1, US2009/0165376A1, US2009/0165384A1, US2009/0217582A1, US2009/0220406A1, US2009/0217590A1, US2009/0217586A1, US2009/0217588A1, US2009/0218424A1, US2009/0217589A1, US2009/0217575A1, US2009/0229182A1, US2009/0217587A1, US2009/0246120A1, US2009/0259080A1, US2009/0260287A1, US2009/0324458A1, US2009/0324459A1, US2009/0324460A1, US2009/0324461A1, US2009/0324462A1, US2010/0071235A1, US2010/0071262A1, US2010/0120926A1, US2010/0121125A1, US2010/0168494A1, US2010/0168495A1, US2010/0179232A1, US2010/0287835A1, US2010/0287836A1, US2010/0292350A1, US2011/0031439A1, US2011/0062012A1, US2011/0062721A1, US2011/0062722A1, US2011/0064648A1, US2011/0088896A1, US2011/0088897A1, US2011/0146978A1, US2011/0146979A1, US2011/0207002A1, US2011/0217602A1, US2011/0262323A1, US2012/0046510A1, US2012/0060417A1, US2012/0102836A1, US2012/0102837A1, US2012/0213680A1, US2012/0271072A1, US2012/0305848A1, US2013/0046124A1, US2013/0042824A1, WO2011/029278A1, WO2011/029282A1, WO2011/029283A1, WO2011/029284A1, WO2011/029285A1, WO2011/063608A1 and GB1599932. See also Chiaramonte et al, "Upgrade Coke by Gasification", *Hydrocarbon Processing*, September 1982, pp. 255-257; and Kalina et al, "Exxon Catalytic Coal Gasification Process Predevelopment Program, Final Report", Exxon Research and Engineering Co., Baytown, Tex., FE236924, December 1978.

The hydromethanation of a carbon source typically involves three theoretically separate primary reactions:

Steam carbon: $C+H_2O \rightarrow CO+H_2$ (I) (highly endothermic)

Water-gas shift: $CO+H_2O \rightarrow H_2+CO_2$ (II) (exothermic)

CO Methanation: $CO+3H_2 \rightarrow CH_4+H_2O$ (III) (highly exothermic)

In the hydromethanation reaction, these three reactions (I-III) desirably balance to result in the following overall "hydromethanation" reaction:

$2C+2H_2O \rightarrow CH_4+CO_2$ (IV) (substantially thermally neutral).

Other theoretical reactions may also occur in the course of hydromethanation, but these are considered to have minimal impact in the overall reaction scheme and end result.

The overall hydromethanation reaction (IV) is essentially thermally balanced; however, due to process heat losses and other energy requirements (such as required for evaporation of moisture entering the reactor with the feedstock), some heat must be added to maintain the thermal balance.

The term "heat demand" refers to the amount of heat energy that must be added to the hydromethanation reactor (for example, with the steam feed) and/or generated in situ (for example, via a combustion/oxidation reaction with supplied oxygen as discussed below) to keep the hydromethanation reaction in substantial thermal balance, as discussed above and as further detailed below. In the context of the present invention, as discussed below, in steady-state operation of the process, all streams are typically fed into the hydromethanation reactor at a temperature below the operating temperature of the hydromethanation reaction. In that case the "heat demand" will be substantially satisfied by the in situ combustion/oxidation reaction with supplied oxygen (including an oxygen/combustion that occurs as a result of using oxygen as a component of the stripping gas).

The reactions are also essentially syngas (hydrogen and carbon monoxide) balanced (syngas is produced and consumed); therefore, as carbon monoxide and hydrogen are withdrawn with the product gases, carbon monoxide and hydrogen need to be added to the reaction as required to avoid a deficiency.

The term "syngas demand" refers to the maintenance of syngas balance in the hydromethanation reactor for the hydromethanation reaction. As indicated above, in the overall desirable steady-state hydromethanation reaction (see equations (I), (II) and (III) above), hydrogen and carbon monoxide are generated and consumed in relative balance. Because both hydrogen and carbon monoxide are withdrawn as part of the gaseous products, hydrogen and carbon monoxide must be added to (via a superheated syngas feed stream (16) in FIG. 2, and as discussed below) and/or generated in situ in (via a combustion/oxidation reaction with supplied oxygen as discussed below) the hydromethanation reactor in an amount at least required to substantially maintain this reaction balance. For the purposes of the present invention, the amount of hydrogen and carbon monoxide that must be added to and/or generated in situ for the hydromethanation reaction is the "syngas demand".

In order to maintain the net heat of reaction as close to neutral as possible (only slightly exothermic or endothermic), and maintain the syngas balance, a superheated gas stream of steam, carbon monoxide and hydrogen is often fed to the hydromethanation reactor. Frequently, the carbon monoxide and hydrogen streams are recycle streams separated from the product gas, and/or are provided by reforming/partially oxidating a portion of the product methane. See, for example, previously incorporated U.S. Pat. No. 4,094,650, U.S. Pat. No. 6,955,595, US2007/083072A1, US2010/0120926A1, US2010/0287836A1, US2011/0031439A1, US2011/0062722A1 and US2011/0064648A1.

In one variation of the hydromethanation process, required carbon monoxide, hydrogen and heat energy can also at least in part be generated in situ by feeding oxygen into the hydromethanation reactor. The combustion/oxidation of carbon content (including increased steam carbon reaction rates in the region of oxygen feed) is believed to be the primary source of the in situ generation of syngas. See, for example, previously incorporated US2010/0076235A1, US2010/0287835A1, US2011/0062721A1, US2012/0046510A1, US2012/0060417A1, US2012/0102836A1, US2012/0102837A1, US2013/0046124A1 and US2013/0042824A1.

The term "steam demand" refers to the amount of steam that must be added to the hydromethanation reactor via the gas feed streams to the hydromethanation reactor. Steam is consumed in the hydromethanation reaction and some steam must be added to the hydromethanation reactor. The theoretical consumption of steam is two moles for every two moles of carbon in the feed to produce one mole of methane and one mole of carbon dioxide (see equation (IV)). In actual practice, the steam consumption is not perfectly efficient and steam is withdrawn with the product gases; therefore, a greater than theoretical amount of steam needs to be added to the hydromethanation reactor, which added amount is the "steam demand". Steam can be added, for example, via the steam stream and the oxygen-rich gas stream (which are typically combined prior to introduction into the hydromethanation reactor as discussed below), as well as via the stripping gas fed to the char-withdrawal standpipes. The amount of steam to be added (and the source) is discussed in further detail below. Steam generated in situ from the carbonaceous feedstock (e.g., from vaporization of any moisture content of the carbonaceous feedstock, or from an oxidation reaction with hydrogen, methane and/or other hydrocarbons present in or generated from the carbonaceous feedstock) can assist in providing steam; however, it should be noted that any steam generated in situ or fed into the hydromethanation reactor at a temperature lower than the operating temperature within the hydromethanation reactor (the hydromethanation reaction temperature) will have an impact on the "heat demand" for the hydromethanation reaction.

The result is a "direct" methane-enriched raw product gas stream also containing substantial amounts of hydrogen, carbon monoxide and carbon dioxide which can, for example, be directly utilized as a medium BTU energy source, or can be processed to result in a variety of higher-value product streams such as pipeline-quality substitute natural gas, high-purity hydrogen, methanol, ammonia, higher hydrocarbons, carbon dioxide (for enhanced oil recovery and industrial uses) and electrical energy.

A char by-product stream is also produced in addition to the methane-enriched raw product gas stream. The solid char by-product contains unreacted carbon, entrained hydromethanation catalyst and other inorganic components of the carbonaceous feedstock. The by-product char may contain 35 wt % or more carbon depending on the feedstock composition and hydromethanation conditions.

This by-product char is periodically or continuously removed from the hydromethanation reactor, and typically sent to a catalyst recovery and recycle operation to improve economics and commercial viability of the overall process. The nature of catalyst components associated with the char extracted from a hydromethanation reactor and methods for their recovery are disclosed, for example, in previously incorporated US2007/0277437A1, US2009/0165383A1, US2009/0165382A1, US2009/0169449A1, US2009/0169448A1, US2011/0262323A1, US2012/0213680A1 and US2012/0271072A1. Catalyst recycle can be supplemented with makeup catalyst as needed, such as disclosed in previously incorporated US2009/0165384A1.

In an embodiment of a hydromethanation process in accordance with the present invention as illustrated in FIG. 2, catalyzed carbonaceous feedstock (32+35), steam stream (12*a*) and, optionally, superheated syngas feed stream (16) are introduced into hydromethanation reactor (200). In addition, an amount of an oxygen-enriched gas stream (14*a*) is typically also introduced into hydromethanation reactor (200) for in situ generation of heat energy and syngas, as generally discussed above and disclosed in many of the previously incorporated references (see, for example, previously incorporated US2010/0076235A1, US2010/0287835A1, US2011/0062721A1, US2012/0046510A1, US2012/0060417A1, US2012/0102836A1 and US2012/0102837A1).

Steam stream (12*a*), oxygen-enrich gas stream (14*a*) and superheated syngas feed stream (16) (if present) are desirably introduced into hydromethanation reactor at a temperature below the target operating temperature of the hydromethanation reaction, as disclosed in previously incorporated US2012/0046510A1. Although under those conditions this has a negative impact on the heat demand of the hydromethanation reaction, this advantageously allows full steam/heat integration of the hydromethanation portion of the process, without the use of fuel-fired superheaters (in steady-state operation of the process) that are typically fueled with a portion of the product from the process.

Typically, superheated syngas feed stream (16) will not be present in steady-state operation of the process, especially when oxygen-enrich gas stream (14*a*) is utilized.

Hydromethanation reactor (200) is a fluidized-bed reactor. The catalyzed carbonaceous feedstock (32+35), which is in whole or predominant part an agglomerated particulate low-rank coal feedstock in accordance with the present invention, has an average particle size (dp(50)) of from about 100 microns, or greater than 100 microns, or from about 200 microns, or from about 250 microns, up to about 1000 microns, or up to about 750 microns, or up to about 600 microns. One skilled in the art can readily determine the appropriate particle size for the carbonaceous particulates. For example, such carbonaceous particulates should have an average particle size which enables incipient fluidization of the carbonaceous materials at the gas velocity used in the fluidized bed reactor. Desirable particle size ranges for the hydromethanation reactor (200) are in the Geldart A and Geldart B ranges (including overlap between the two), depending on fluidization conditions, typically with limited amounts of fine (below about 45 microns) and coarse (greater than about 1500 microns) material.

The agglomerated particulate low-rank coal feedstock for use with a hydromethanation process should have this same particle size distribution and profile.

Hydromethanation reactor (200) can, for example, be a "flow down" countercurrent configuration, where the catalyzed carbonaceous feedstock (32+35) is introduced at a higher point so that the particles flow down the fluidized bed (202) toward lower portion (202*a*) of fluidized bed (202), and the gases flow in an upward direction and are removed at a point above the fluidized bed (202).

Alternatively, hydromethanation reactor (200) can have a "flow up" co-current configuration, where the catalyzed carbonaceous feedstock (32+35) is fed at a lower point (bottom portion (202*a*) of fluidized bed (202)) so that the particles flow up the fluidized bed (202), along with the gases, to a char by-product removal zone, for example, near or at the top of upper portion (202*b*) of fluidized bed (202), to the top of fluidized bed (202).

In one embodiment, the feed point of the carbonaceous feedstock (such as catalyzed carbonaceous feedstock (32+35)) should result in introduction into fluidized bed (200) as close to the point of introduction of oxygen (from oxygen-enrich gas stream (14*a*)) as reasonably possible. See, for example, previously incorporated US2012/0102836A1.

Char by-product removal from hydromethanation reactor (200) can be at any desired place or places, for example, at the top of fluidized bed (202), at any place within upper portion (202*b*) and/or lower portion (202*a*) of fluidized bed (202), and/or at or just below a grid plate (208) at the bottom of fluidized bed (202). The location where catalyzed carbonaceous feedstock (32+35) is introduced will have an influence on the location of a char withdrawal point.

For example, in the embodiment where catalyzed carbonaceous feedstock (32+35) is introduced into lower portion (202*a*) of fluidized bed (202), at least one char withdrawal line (58) will be located at a point such that by-product char is withdrawn from fluidized bed (202) at one or more points above the feed location of catalyzed carbonaceous feedstock (32+35).

In this embodiment, due to the lower feed point of catalyzed carbonaceous feedstock (32+35) into hydromethanation reactor (200), and higher withdrawal point of by-product char from hydromethanation reactor (200), hydromethanation reactor (200) with be a flow-up configuration as discussed above.

Hydromethanation reactor (200) also typically comprises a zone (206) below fluidized-bed (202), with the two sections typically being separated by grid plate (208) or a similar divider (for example, an array of sparger pipes). Particles too large to be fluidized in fluidized-bed section (202), for example large-particle by-product char and non-fluidizable agglomerates, are generally collected in lower portion (202*a*) of fluidized bed (202), as well as zone (206). Such particles will typically comprise a carbon content (as well as an ash and catalyst content), and may be removed periodically from hydromethanation reactor (200) via a char withdrawal line (58) for catalyst recovery and further processing.

Typically, there will be at least one char withdrawal point at or below grid plate (208) to withdraw char comprising larger or agglomerated particles.

Hydromethanation reactor (200) is typically operated at moderately high pressures and temperatures, requiring introduction of solid streams (e.g., catalyzed agglomerated particulate low-rank feedstock (32+35) and if present recycle fines) to the reaction chamber of the reactor while maintaining the required temperature, pressure and flow rate of the streams. Those skilled in the art are familiar with feed inlets to supply solids into the reaction chambers having high pressure and/or temperature environments, including star feeders, screw feeders, rotary pistons and lock-hoppers. It should be understood that the feed inlets can include two or more pressure-balanced elements, such as lock hoppers, which would be used alternately. In some instances, the carbonaceous feedstock can be prepared at pressure conditions above the operating pressure of the reactor and, hence, the particulate composition can be directly passed into the reactor without further pressurization. Gas for pressurization can be an inert gas such as nitrogen, or more typically a stream of carbon dioxide that can, for example be recycled from a carbon dioxide stream generated by an acid gas removal unit.

Hydromethanation reactor (200) is desirably operated at a moderate temperature (as compared to "conventional" oxidation-based gasification processes), with an operating temperature of at least about 1000° F. (about 538° C.), or at least about 1100° F. (about 593° C.), to about 1500° F. (about 816° C.), or to about 1400° F. (about 760° C.), or to about 1300° F. (704° C.); and a pressure of about 250 psig (about 1825 kPa, absolute), or about 400 psig (about 2860 kPa), or about 450 psig (about 3204 kPa), to about 1000 psig (about 6996 kPa), or to about 800 psig (about 5617 kPa), or to about 700 psig (about 4928 kPa), or to about 600 psig (about 4238 kPa), or to about 500 psig (about 3549 kPa). In one embodiment, hydromethanation reactor (200) is operated at a pressure (first operating pressure) of up to about 600 psig (about 4238 kPa), or up to about 550 psig (about 3894 kPa).

Typical gas flow velocities in hydromethanation reactor (200) are from about 0.5 ft/sec (about 0.15 m/sec), or from about 1 ft/sec (about 0.3 m/sec), to about 2.0 ft/sec (about 0.6 m/sec), or to about 1.5 ft/sec (about 0.45 m/sec).

As oxygen-enriched gas stream (14*a*) is fed into hydromethanation reactor (200), a portion of the carbonaceous feedstock (desirably carbon from the partially reacted feedstock, by-product char and recycled fines) will be consumed in an oxidation/combustion reaction, generating heat energy as well as typically some amounts carbon monoxide and hydrogen (and typically other gases such as carbon dioxide and steam). The variation of the amount of oxygen supplied to hydromethanation reactor (200) provides an advantageous process control to ultimately maintain the syngas and heat balance. Increasing the amount of oxygen will increase the oxidation/combustion, and therefore increase in situ heat generation. Decreasing the amount of oxygen will conversely decrease the in situ heat generation. The amount of syngas generated will ultimately depend on the amount of oxygen utilized, and higher amounts of oxygen may result in a more complete combustion/oxidation to carbon dioxide and water, as opposed to a more partial combustion (and steam carbon reaction) to carbon monoxide and hydrogen.

The amount of oxygen supplied to hydromethanation reactor (200) must be sufficient to combust/oxidize enough of the carbonaceous feedstock to generate enough heat energy and syngas to meet the heat and syngas demands of the steady-state hydromethanation reaction.

In one embodiment, the amount of molecular oxygen (as contained in the oxygen-enriched gas stream (14*a*)) that is provided to the hydromethanation reactor (200) can range from about 0.10, or from about 0.20, or from about 0.25, to about 0.6, or to about 0.5, or to about 0.4, or to about 0.35 pounds of $O_2$ per pound of carbon in catalyzed agglomerated particulate low-rank feedstock (32+35).

The hydromethanation and oxidation/combustion reactions within hydromethanation reactor (200) will occur contemporaneously. Depending on the configuration of hydromethanation reactor (200), the two steps will typically predominant in separate zones—the hydromethanation in upper portion (202*b*) of fluidized bed (202), and the oxidation/combustion in lower portion (202*a*) of fluidized bed (202). The oxygen-enriched gas stream (14*a*) is typically mixed with steam stream (12) and the mixture introduced at or near the bottom of fluidized bed (202) in lower portion (202*a*) to avoid formation of hot spots in the reactor, and to avoid (minimize) combustion of the desired gaseous products. Feeding the catalyzed carbonaceous feedstock (32+35) with an elevated moisture content, and particularly into lower portion (202*a*) of fluidized bed (202), also assists in heat dissipation and the avoidance if formation of hot spots in reactor (200), as indicated in previously incorporated US2012/0102837A1.

If superheated syngas feed stream (16) is present, that stream will typically be introduced as a mixture with steam stream (12*a*), with oxygen-enriched gas stream (14*a*) introduced separately into lower portion (202*a*) of fluidized bed (202) so as to not preferentially consume the syngas components.

The oxygen-enriched gas stream (14*a*) can be fed into hydromethanation reactor (200) by any suitable means such as direct injection of purified oxygen, oxygen-air mixtures, oxygen-steam mixtures, or oxygen-inert gas mixtures into the reactor. See, for instance, U.S. Pat. No. 4,315,753 and Chiaramonte et al., Hydrocarbon Processing, September 1982, pp. 255-257.

The oxygen-enriched gas stream (14*a*) is typically generated via standard air-separation technologies, and will be fed mixed with steam, and introduced at a temperature above about 250° F. (about 121° C.), to about 400° F. (about 204° C.), or to about 350° F. (about 177° C.), or to about 300° F. (about 149° C.), and at a pressure at least slightly higher than present in hydromethanation reactor (200). The steam in oxygen-enriched gas stream (14*a*) should be non-condensable during transport of oxygen-enriched stream (14*a*) to hydromethanation reactor (200), so oxygen-enriched stream (14*a*) may need to be transported at a lower pressure then pressurized (compressed) just prior to introduction into hydromethanation reactor (200).

As indicated above, the hydromethanation reaction has a steam demand, a heat demand and a syngas demand. These conditions in combination are important factors in determining the operating conditions for the hydromethanation reaction as well as the remainder of the process.

For example, the hydromethanation reaction requires a theoretical molar ratio of steam to carbon (in the feedstock) of at least about 1. Typically, however, the molar ratio is greater than about 1, or from about 1.5 (or greater), to about 6 (or less), or to about 5 (or less), or to about 4 (or less), or to about 3 (or less), or to about 2 (or less). The moisture content of the catalyzed carbonaceous feedstock (32+35), moisture generated from the feedstock in the hydromethanation reactor (200), and steam included in the steam stream (12*a*), oxygen-enriched gas stream (14*a*) and recycle fines stream(s) (and optional superheated syngas feed stream (16)), all contribute steam for the hydromethanation reaction. The steam in steam stream (12*a*) should be sufficient to at least substantially satisfy (or at least satisfy) the "steam demand" of the hydromethanation reaction.

As also indicated above, the hydromethanation reaction is essentially thermally balanced but, due to process heat losses and other energy requirements (for example, vaporization of moisture on the feedstock), some heat must be generated in the hydromethanation reaction to maintain the thermal balance (the heat demand). The partial combustion/oxidation of carbon in the presence of the oxygen introduced into hydromethanation reactor (200) from oxygen-enriched gas stream (14*a*) should be sufficient to at least substantially satisfy (or at least satisfy) both the heat and syngas demand of the hydromethanation reaction.

The gas utilized in hydromethanation reactor (200) for pressurization and reaction of the catalyzed carbonaceous feedstock (32+35) comprises the steam stream (12*a*) and oxygen-enriched gas stream (14*a*) (and optional superheated syngas feed stream (16)) and, optionally, additional nitrogen, air, or inert gases such as argon, which can be supplied to hydromethanation reactor (200) according to methods known to those skilled in the art. As a consequence, steam stream (12*a*) and oxygen-enriched gas stream (14*a*) must be provided at a higher pressure which allows them to enter hydromethanation reactor (200).

In one embodiment, all streams should be fed into hydromethanation reactor (200) at a temperature less than the target operating temperature of the hydromethanation reactor, such as disclosed in previously incorporated US2012/0046510A1.

Steam stream (12*a*) will be at a temperature above the saturation point at the feed pressure. When fed into hydromethanation reactor (200), steam stream (12*a*) should be a superheated steam stream to avoid the possibility of any condensation occurring. Typical feed temperatures of steam stream (12) are from about 400° F. (about 204° C.), or from about 450° F. (about 232° C.), to about 650° F. (about 343° C.), or to about 600° F. (about 316° C.). Typical feed pressures of steam stream (12) are about 25 psi (about 172 kPa) or greater than the pressure within hydromethanation reactor (200).

The actual temperature and pressure of steam stream (12*a*) will ultimately depend on the level of heat recovery from the process and the operating pressure within hydromethanation reactor (200), as discussed below. In any event, desirably no fuel-fired superheater should be used in the superheating of steam stream (12*a*) in steady-state operation of the process.

When steam stream (12*a*) and oxygen-enriched stream (14*a*) are combined for feeding into lower section (202*a*) of fluidized bed (202), the temperature of the combined stream will be controlled by the temperature of steam stream (12*a*), and will typically range from about from about from about 400° F. (about 204° C.), or from about 450° F. (about 232° C.), to about 650° F. (about 343° C.), or to about 600° F. (about 316° C.).

The temperature in hydromethanation reactor (200) can be controlled, for example, by controlling the amount and temperature of steam stream (12*a*), as well as the amount of oxygen supplied to hydromethanation reactor (200).

In steady-state operation, steam for the hydromethanation reaction is desirably solely generated from other process operations through process heat capture (such as generated in a waste heat boiler, generally referred to as "process steam" or "process-generated steam"), specifically from the cooling of the raw product gas in a heat exchanger unit. Additional steam can be generated for other portions of the overall process, such as disclosed, for example, in previously incorporated US2010/0287835A1 and US2012/0046510A1.

The overall process described herein is desirably steam positive, such that steam demand (pressure and amount) for the hydromethanation reaction can be satisfied via heat exchange, with process heat recovery at the different stages allowing for production of excess steam that can be used for power generation and other purposes. Desirably, process-generated steam from accounts for 100 wt % or greater of the steam demand of the hydromethanation reaction.

The result of the hydromethanation reaction is a methane-enriched raw product, which is withdrawn from hydromethanation reactor (200) as methane-enriched raw product stream (50) typically comprising $CH_4$, $CO_2$, $H_2$, CO, $H_2S$, unreacted steam and, optionally, other contaminants such as entrained fines, $NH_3$, COS, HCN and/or elemental mercury vapor, depending on the nature of the carbonaceous material utilized for hydromethanation.

If the hydromethanation reaction is run in syngas balance, the methane-enriched raw product stream (50), upon exiting the hydromethanation reactor (200), will typically comprise at least about 15 mol %, or at least about 18 mol %, or at least about 20 mol %, methane based on the moles of methane, carbon dioxide, carbon monoxide and hydrogen in the methane-enriched raw product stream (50). In addition, the methane-enriched raw product stream (50) will typically comprise at least about 50 mol % methane plus carbon dioxide, based on the moles of methane, carbon dioxide, carbon monoxide and hydrogen in the methane-enriched raw product stream (50).

If the hydromethanation reaction is run in syngas excess, e.g., contains an excess of carbon monoxide and/or hydrogen above and beyond the syngas demand (for example, excess carbon monoxide and/or hydrogen are generated due to the amount of oxygen-enriched gas stream (14*a*) fed to hydromethanation reactor (200)), then there may be some dilution effect on the molar percent of methane and carbon dioxide in methane-enriched raw product stream (50).

Advantageously, the hydromethanation catalyst can comprise one or more catalyst species, as discussed below, and can function as the binder material for the catalyzed agglomerated particulate low-rank feedstock (32+35).

The carbonaceous feedstock (32+35) and the hydromethanation catalyst are typically intimately mixed (i.e., to provide a catalyzed carbonaceous feedstock (32+35)) before provision to the hydromethanation reactor (200), but they can be fed separately as well. In such a case, a separate binder material is required for the catalyzed agglomerated particulate low-rank feedstock (32+35).

Typically, the methane-enriched raw product passes through an initial disengagement zone (204) above the fluidized-bed section (202) prior to withdrawal from hydromethanation reactor (200). The disengagement zone (204) may optionally contain, for example, one or more internal cyclones and/or other entrained particle disengagement mechanisms. The "withdrawn" methane-enriched raw product gas stream (50) typically comprises at least methane, carbon monoxide, carbon dioxide and hydrogen as discussed above, as well hydrogen sulfide, steam, heat energy and entrained fines.

The methane-enriched raw product gas stream (50) is initially treated to remove a substantial portion of the entrained fines, typically via a cyclone assembly (360) (for example, one or more internal and/or external cyclones), which may be followed if necessary by optional additional treatments such as Venturi scrubbers, as discussed in more detail below. The "withdrawn" methane-enriched raw product gas stream (50), therefore, is to be considered the raw product prior to fines separation, regardless of whether the fines separation takes place internal to and/or external of hydromethanation reactor (200).

Removal of a "substantial portion" of fines means that an amount of fines is removed from the resulting gas stream such that downstream processing is not adversely affected; thus, at least a substantial portion of fines should be removed. Some minor level of ultrafine material may remain in the resulting gas stream to the extent that downstream processing is not significantly adversely affected. Typically, at least about 90 wt %, or at least about 95 wt %, or at least about 98 wt %, of the fines of a particle size greater than about 20 μm, or greater than about 10 μm, or greater than about 5 μm, are removed.

As specifically depicted in FIG. 2, the methane-enriched raw product stream (50) is passed from hydromethanation reactor (200) to a cyclone assembly (360) for entrained particle separation. While cyclone assembly (360) is shown in FIG. 2 as a single external cyclone for simplicity, as indicated above cyclone assembly (360) may be an internal and/or external cyclone, and may also be a series of multiple internal and/or external cyclones.

The methane-enriched raw product gas stream (50) is treated in cyclone assembly (360) to generate a fines-depleted methane-enriched raw product gas stream (52) and a recovered fines stream (362).

Recovered fines stream (362) may be fed back into hydromethanation reactor (202), for example, into upper portion (202*b*) of fluidized bed (202) via fines recycle line (364), and/or into lower portion (202*a*) of fluidized bed (202) via fines recycle line (366) (as disclosed in previously incorporated US2012/0060417A1). To the extent not fed back into fluidized bed (202), recovered fines stream (362) may, for example, be recycled back to feedstock preparation unit (100) and/or a catalyst recovery unit (300), and/or combined with ground low-rank coal feedstock (32) and/or catalyzed carbonaceous feedstock (32+35).

The fines-depleted methane-enriched raw product gas stream (52) typically comprises at least methane, carbon monoxide, carbon dioxide, hydrogen, hydrogen sulfide, steam, ammonia and heat energy, as well as small amounts of contaminants such as remaining residual entrained fines, and other volatilized and/or carried material (for example, mercury) that may be present in the carbonaceous feedstock. There are typically virtually no (total typically less than about 50 ppm) condensable (at ambient conditions) hydrocarbons present in fines-depleted methane-enriched raw product gas stream (52).

The fines-depleted methane-enriched raw product gas stream (52) can be treated in one or more downstream processing steps to recover heat energy, decontaminate and convert, to one or more value-added products such as, for example, substitute natural gas (pipeline quality), hydrogen, carbon monoxide, syngas, ammonia, methanol and other syngas-derived products, electrical power and steam, as disclosed in many of the documents referenced at the start of this "Hydromethanation" section.

Catalysts for Hydromethanation

The hydromethanation catalyst is potentially active for catalyzing at least reactions (I), (II) and (III) described above. Such catalysts are in a general sense well known to those of ordinary skill in the relevant art and may include, for example, alkali metals, alkaline earth metals and transition metals, and compounds and complexes thereof. Typically, the hydromethanation catalyst comprises at least an alkali metal, such as disclosed in many of the previously incorporated references.

Advantageously, the hydromethanation catalyst is an alkali metal, which also functions as the binder material (35) for the agglomerated particulate low-rank coal feedstock.

Suitable alkali metals are lithium, sodium, potassium, rubidium, cesium, and mixtures thereof. Particularly useful are potassium sources. Suitable alkali metal compounds include alkali metal carbonates, bicarbonates, formates, oxalates, amides, hydroxides, acetates, or similar compounds. For example, the catalyst can comprise one or more of sodium carbonate, potassium carbonate, rubidium carbonate, lithium carbonate, cesium carbonate, sodium hydroxide, potassium hydroxide, rubidium hydroxide or cesium hydroxide, and particularly, potassium carbonate and/or potassium hydroxide.

Optional co-catalysts or other catalyst additives may be utilized, such as those disclosed in the previously incorporated references.

Typically, when the hydromethanation catalyst is solely or substantially an alkali metal, it is present in the catalyzed carbonaceous feedstock (32+35) in an amount sufficient to provide a ratio of alkali metal atoms to carbon atoms in the catalyzed carbonaceous feedstock ranging from about 0.01, or from about 0.02, or from about 0.03, or from about 0.04, to about 0.10, or to about 0.08, or to about 0.07, or to about 0.06.

Catalyst Recovery (300)

Reaction of the catalyzed carbonaceous feedstock (32+35) under the described conditions generally provides the methane-enriched raw product stream (50) and a solid char by-product (58).

The solid char by-product (58) typically comprises quantities of unreacted carbon, inorganic ash and entrained catalyst. The solid char by-product (58) can removed from the hydromethanation reactor (200) for sampling, purging, and/or catalyst recovery.

The term "entrained catalyst" as used herein means chemical compounds comprising the catalytically active portion of the hydromethanation catalyst, e.g., alkali metal compounds present in the char by-product. For example, "entrained catalyst" can include, but is not limited to, soluble alkali metal compounds (such as alkali metal carbonates, alkali metal hydroxides and alkali metal oxides) and/or insoluble alkali compounds (such as alkali metal aluminosilicates). The nature of catalyst components associated with the char extracted are discussed, for example, in previously incorporated US2007/0277437A1, US2009/0165383A1, US2009/0165382A1, US2009/0169449A1 and US2009/0169448A1.

As the hydromethanation reactor is a pressurized vessel, removal of by-product char from the hydromethanation reactor can involve the use of a lock-hopper unit, which is a series of pressure-sealed chambers for bringing the removed solids to a pressure appropriate for further processing. Other methods for char removal are disclosed, for example, in EP-A-0102828, CN101555420A and commonly-owned U.S. patent application Ser. No. 13/644,207, entitled HYDROMETHANATION OF A CARBONACEOUS FEEDSTOCK), which was filed 3 Oct. 2012.

The char by-product stream (or streams) (58) from the hydromethanation reactor (200) may be passed to a catalyst recovery unit (300), as described below. The char by-product stream (58) may also be split into multiple streams, one of which may be passed to a catalyst recovery unit (300), and another stream which may be used, for example, as a methanation catalyst (as described in previously incorporated US2010/0121125A1) and not treated for catalyst recovery.

In certain embodiments, when the hydromethanation catalyst is an alkali metal, the alkali metal in the solid char by-product can be recovered to produce a catalyst recycle stream (57), and any unrecovered catalyst can be compensated by a catalyst make-up stream (56) (see, for example, previously incorporated US2009/0165384A1). The more alumina plus silica that is in the feedstock, the more costly it is to obtain a higher alkali metal recovery.

In one embodiment, the solid char by-product from the hydromethanation reactor (200) is fed to a quench tank where it is quenched with an aqueous medium to extract a portion of the entrained catalyst such as, for example, as disclosed in previously incorporated US2007/0277437A1. A slurry of the quenched char can then optionally be passed to a leaching tank where a substantial portion of water-insoluble entrained catalyst is converted into a soluble form, then subject to a solids/liquid separation to generate a recycle catalyst stream (57) and a depleted char stream (59) such as, for example, disclosed in previously incorporated US2009/0169449A1, US2009/0169448A1, US2011/0262323A1 and US2012/0213680A1.

Ultimately, the recovered catalyst (57) can be directed to the pelletization unit (350) for reuse of the alkali metal catalyst.

In the event that the hydromethanation catalyst does not function as the binder material, one or both of the catalyst make-up stream (56) and catalyst recycle stream (57) are desirably provided to pelletization unit (350) and, more particularly, pelletizer (140) along with the binder.

Other particularly useful recovery and recycling processes are described in U.S. Pat. No. 4,459,138, as well as previously incorporated US2007/0277437A1 US2009/0165383A1, US2009/0165382A1, US2009/0169449A1 and US2009/0169448A1. Reference can be had to those documents for further process details.

The recycle of catalyst can be to one or a combination of catalyst loading processes. For example, all of the recycled catalyst can be supplied to one catalyst loading process, while another process utilizes only makeup catalyst. The levels of recycled versus makeup catalyst can also be controlled on an individual basis among catalyst loading processes.

As indicated above, all or a portion of recovered fines stream (362) can be co-treated in catalyst recovery unit (300) along with by-product char (58).

The result of treatment for catalyst and other by-product recovery is a "cleaned" depleted char (59), at least a portion of which can be provided to a carbon recovery unit (325) to generate a carbon-enriched and inorganic ash-depleted stream (65) and carbon-depleted and inorganic ash-enriched stream (66), as disclosed in previously incorporated US2012/0271072A1.

At least a portion, or at least a predominant portion, or at least a substantial portion, or substantially all, of the carbon-enriched and inorganic ash-depleted stream (65) can be recycled back to feedstock preparation unit (100), and/or can be combined with ground low-rank coal feedstock (32) and/or catalyzed carbonaceous feedstock (32+35) for processing and/or ultimately feeding back to hydromethanation reactor (200).

The resulting carbon-depleted and inorganic ash-enriched stream (66) will still retain some residual carbon content and can, for example, be combusted to power one or more steam generators (such as disclosed in previously incorporated US2009/0165376A1)), or used as such in a variety of applications, for example, as an absorbent (such as disclosed in previously incorporated US2009/0217582A1), or disposed of in an environmentally acceptable manner.

(2) Combustion Processes

As a general concept, in combustion processes the carbon in a carbonaceous feedstock is burned for heat which can be recovered, for example, to generate steam various industrial uses, and for exhaust gases that can be used to drive turbines for electricity generation.

Suitable fluidized-bed combustion technologies are generally known to those of ordinary skill in the relevant art, and many applicable technologies are commercially available.

On such technology utilizes a pulverized coal boiler ("PCB"). PCBs operate at high temperatures of from about 1300° C. to about 1700° C. PCBs utilize finer particles having a dp(50) ranging from about 100 to about 200 microns.

Fluidized-bed boilers can be operated at various pressures ranging from atmospheric to much higher pressure conditions, and typically use air for the fluidizing medium, which is typically enriched in oxygen to promote combustion.

Multi-Train Processes

In the processes of the invention, each process may be performed in one or more processing units. For example, one or more hydromethanation reactors may be supplied with the feedstock from one or more feedstock preparation unit operations. Similarly, the methane-enriched raw product streams generated by one or more hydromethanation reactors may be processed or purified separately or via their combination at various downstream points depending on the particular system configuration, as discussed, for example, in previously incorporated US2009/0324458A1, US2009/0324459A1, US2009/0324460A1, US2009/0324461A1 and US2009/0324462A1.

In certain embodiments, the processes utilize two or more reactors (e.g., 2-4 hydromethanation reactors). In such embodiments, the processes may contain divergent processing units (i.e., less than the total number of hydromethanation reactors) prior to the reactors for ultimately providing the carbonaceous feedstock to the plurality of reactors, and/or convergent processing units (i.e., less than the total number of hydromethanation reactors) following the reactors for processing the plurality of raw gas streams generated by the plurality of reactors.

When the systems contain convergent processing units, each of the convergent processing units can be selected to have a capacity to accept greater than a 1/n portion of the total feed stream to the convergent processing units, where n is the number of convergent processing units. Similarly, when the systems contain divergent processing units, each of the divergent processing units can be selected to have a capacity to accept greater than a 1/m portion of the total feed stream supplying the convergent processing units, where m is the number of divergent processing units.

We claim:

1. A process for preparing a free-flowing agglomerated particulate low-rank coal feedstock of a specified particle size distribution, the process comprising the steps of:

(A) selecting a specification for the particle size distribution of the free-flowing agglomerated particulate low-rank coal feedstock, the specification comprising
  (i) a target dp(50) that is a value in the range of from about 100 microns to about 1000 microns,
  (ii) a target upper end particle size that is a value greater than the target dp(50), and less than or equal to about 1500 microns, and
  (iii) a target lower end particle size that is a value less than the target dp(50), and greater than or equal to about 45 microns;

(B) providing a raw particulate low-rank coal feedstock having an initial particle density;

(C) grinding the raw particulate low-rank coal feedstock to a ground dp(50) of from about 2% to about 50% of the target dp(50), to generate a ground low-rank coal feedstock;

(D) pelletizing the ground low-rank coal feedstock with water and a binder to generate free-flowing agglomerated low-rank coal particles having a pelletized dp(50) of from about 90% to about 110% of the target dp(50), and a particle density of at least about 5% greater than the initial particle density, wherein the binder is selected from the group consisting of a water-soluble binder, a water-dispersible binder and a mixture thereof; and (E) removing all or a portion of (i) particles larger than the upper end particle size, (ii) particles smaller than the lower end particle size, or (iii) both (i) and (ii), from the free-flowing agglomerated low-rank coal particles to generate the free-flowing agglomerated low-rank coal feedstock.

2. The process of claim 1, wherein about 90 wt % or greater of (i) particles larger than the upper end particle size, and (ii) particles smaller than the lower end particle size, are removed from the free-flowing agglomerated low-rank coal particles to generate the free-flowing agglomerated low-rank coal feedstock.

3. The process of claim 1, wherein the particle density of the free-flowing agglomerated low-rank coal particles is at least about 10% greater than the initial particle density.

4. The process of claim 1, wherein the raw particulate low-rank coal feedstock is ground to a ground dp(50) of from about 5% to about 50% of the target dp(50).

5. The process of claim 1, wherein the raw low-rank particulate coal feedstock has a Hardgrove Grinding Index of about 50 or greater.

6. The process of claim 5, wherein the raw low-rank particulate coal feedstock has a Hardgrove Grinding Index of about 70 or greater.

7. The process of claim 6, wherein the raw low-rank particulate coal feedstock has a Hardgrove Grinding Index of from about 70 to about 130.

8. The process of claim 1, wherein the grinding step is a wet grinding step.

9. The process of claim 8, wherein an acid is added in the wet grinding step.

10. The process of claim 1, wherein the process further comprises the step of washing the raw ground low-rank coal feedstock from the grinding step to generate a washed ground low-rank coal feedstock.

11. The process of claim 10, wherein the raw ground low-rank coal feedstock is washed to remove one or both of inorganic sodium and inorganic chlorine.

12. The process of claim 11, wherein the washed ground low-rank coal has a water content, and the process further comprises the step of removing a portion of the water content from the washed ground low-rank coal feedstock to generate the ground low-rank coal feedstock for the pelletizing step.

13. The process of claim 1, wherein the binder comprises an alkali metal.

14. The process of claim 1, wherein the pelletization is a two-stage pelletization performed by a first type of pelletizer followed in series by a second type of pelletizer.

15. A process for hydromethanating a low-rank coal feedstock to a raw methane-enriched synthesis gas stream comprising methane, carbon monoxide, hydrogen and carbon dioxide, the process comprising the steps of:

(a) preparing a low-rank coal feedstock of a specified particle size distribution;

(b) feeding into the fluidized-bed hydromethanation reactor (i) low-rank coal feedstock prepared in step (a), (ii) steam, (iii) one or both of (1) oxygen and (2) a syngas stream comprising carbon monoxide and hydrogen, and (iv) a hydromethanation catalyst, wherein the hydromethanation catalyst is fed into the fluidized-bed hydromethanation reactor either (1) as part of the low-rank coal feedstock prepared in step (a), or (2) separately from the low-rank coal feedstock prepared in step (a), or (3) both (1) and (2);

(c) reacting low-rank coal feedstock fed into the hydromethanation reactor in step (b) with steam in the presence of carbon monoxide, hydrogen and hydromethanation catalyst, at a temperature of from about 1000° F. (about 538° C.) to about 1500° F. (about 816° C.), and a pressure of from about 400 psig (about 2860 kPa) to about 1000 psig (about 6996 kPa), to generate a raw gas comprising methane, carbon monoxide, hydrogen and carbon dioxide; and (d) removing a stream of the raw gas from the hydromethanation reactor as the raw methane-enriched synthesis gas stream, wherein the raw methane-enriched synthesis gas stream comprises (i) at least about 15 mol % methane based on the moles of methane, carbon dioxide, carbon monoxide and hydrogen in the methane-enriched raw product stream, and (ii) at least about 50 mol % methane plus carbon dioxide based on the moles of methane, carbon dioxide, carbon monoxide and hydrogen in the methane-enriched raw product stream, wherein the low-rank coal feedstock comprises a free-flowing agglomerate particulate low-rank coal feedstock, and step (a) comprises the steps of:

(A) selecting a specification for the particle size distribution of the free-flowing agglomerated particulate low-rank coal feedstock, the specification comprising (i) a target dp(50) that is a value in the range of from about 100 microns to about 1000 microns, (ii) a target upper end particle size that is a value greater than the target dp(50), and less than or equal to about 1500 microns, and (iii) a target lower end particle size that is a value less than the target dp(50), and greater than or equal to about 45 microns;

(B) providing a raw particulate low-rank coal feedstock having an initial particle density;

(C) grinding the raw particulate low-rank coal feedstock to a ground dp(50) of from about 2% to about 50% of the target dp(50), to generate a ground low-rank coal feedstock;

(D) pelletizing the ground low-rank coal feedstock with water and a binder to generate free-flowing agglomerated low-rank coal particles having a pelletized dp(50) of from about 90% to about 110% of the target dp(50), and a particle density of at least about 5% greater than the initial particle density, wherein the binder is selected from the group consisting of a water-soluble binder, a water-dispersible binder and a mixture thereof; and (E) removing all or a portion of (i) particles larger than the upper end particle size, (ii) particles smaller than the lower end particle size, or (iii) both (i) and (ii), from the free-flowing agglomerated low-rank coal particles to generate the free-flowing agglomerated low-rank coal feedstock.

16. The process of claim 15, wherein the binder comprises an alkali metal.

17. The process of claim 16, wherein the alkali metal is potassium.

18. The process of claim 15, wherein the hydromethanation catalyst comprises an alkali metal.

19. The process of claim 18, wherein the hydromethanation catalyst is potassium.

20. The process of claim 18, wherein the hydromethanation catalyst and the binder are the same material.

21. The process of claim 20, wherein the binder comprises hydromethanation catalyst that has been recycled and fresh make up hydromethanation catalyst.

22. The process of claim 15, wherein the pelletization is a two-stage pelletization performed by a first type of pelletizer followed in series by a second type of pelletizer.

23. The process of claim 15, wherein the raw low-rank particulate coal feedstock has a Hardgrove Grinding Index of about 50 or greater.

24. The process of claim 23, wherein the raw low-rank particulate coal feedstock has a Hardgrove Grinding Index of about 70 or greater.

25. The process of claim 24, wherein the raw low-rank particulate coal feedstock has a Hardgrove Grinding Index of from about 70 to about 130.

26. The process of claim 15, wherein the grinding step is a wet grinding step.

27. The process of claim 26, wherein an acid is added in the wet grinding step.

28. The process of claim 15, wherein the process further comprises the step of washing the raw ground low-rank coal feedstock from the grinding step to generate a washed ground low-rank coal feedstock.

29. The process of claim 28, wherein the raw ground low-rank coal feedstock is washed to remove one or both of inorganic sodium and inorganic chlorine.

* * * * *